US009387688B2

(12) United States Patent
Sugiyama et al.

(10) Patent No.: US 9,387,688 B2
(45) Date of Patent: Jul. 12, 2016

(54) EXPOSURE DEVICE AND METHOD FOR PRODUCING THE SAME

(75) Inventors: Yosuke Sugiyama, Gifu (JP); Toshio Sakai, Nagoya (JP); Yasuo Tamaru, Nagoya (JP); Junichi Yokoi, Toyoake (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 404 days.

(21) Appl. No.: 12/506,693

(22) Filed: Jul. 21, 2009

(65) Prior Publication Data

US 2010/0020301 A1 Jan. 28, 2010

(30) Foreign Application Priority Data

Jul. 22, 2008 (JP) ..... 2008-188184
Aug. 26, 2008 (JP) ..... 2008-216615
Aug. 26, 2008 (JP) ..... 2008-216617

(51) Int. Cl.

| | |
|---|---|
| ***B41J 2/45*** | (2006.01) |
| ***B41J 25/308*** | (2006.01) |
| ***G03G 15/32*** | (2006.01) |
| ***G03G 15/04*** | (2006.01) |
| *B41J 2/47* | (2006.01) |

(Continued)

(52) U.S. Cl.

CPC *B41J 2/45* (2013.01); *B41J 25/308* (2013.01); *G03G 15/04054* (2013.01); *G03G 15/326* (2013.01)

(58) Field of Classification Search

CPC ..... B41J 2/45; G03G 15/326
USPC ..... 347/238; 399/217
See application file for complete search history.

(56) References Cited

U.S. PATENT DOCUMENTS 4,437,100 A * 3/1984 Sugitani et al. ..... 347/65
4,733,127 A * 3/1988 Takasu et al. ..... 313/500

(Continued)

FOREIGN PATENT DOCUMENTS

JP 1-190470 A 7/1989
JP 5-088062 A 4/1993

(Continued)

OTHER PUBLICATIONS

EP Office Action dtd Nov. 17, 2010, EP Appln. 09166107.4-1260.

(Continued)

*Primary Examiner* — Jannelle M Lebron
*Assistant Examiner* — Jeremy Bishop
(74) *Attorney, Agent, or Firm* — Banner & Witcoff, Ltd.

(57) ABSTRACT

There is provided an exposure device including an exposure head having a light-emitting member which has a plurality of light-emitting sections arranged in a row and a casing which holds the light-emitting member and which is elongated in a longitudinal direction orthogonal to an optical axis direction of a light emitted from the light-emitting sections; and an elongated frame member fixed to the casing and having a reference portion at which the frame member is positioned with respect to the light-emitting sections; wherein the frame member is fixed to the casing such that the frame member is positioned with respect to the light-emitting sections in both of the longitudinal direction and a width direction of the casing, the width direction being orthogonal to the longitudinal direction and the optical axis direction. The exposure device is capable of performing exposure precisely at a desired exposure position.

30 Claims, 16 Drawing Sheets

(51) Int. Cl.

| | |
|---|---|
| *B41J 15/14* | (2006.01) |
| *B41J 27/00* | (2006.01) |
| *B41J 2/435* | (2006.01) |
| *G03G 15/26* | (2006.01) |

(56) References Cited

U.S. PATENT DOCUMENTS

| | | | | |
|---|---|---|---|---|
| 5,235,348 | A * | 8/1993 | Avonts | 347/238 |
| 5,291,039 | A * | 3/1994 | Ogata et al. | 257/99 |
| 5,321,429 | A * | 6/1994 | Ono et al. | 347/238 |
| 5,403,102 | A * | 4/1995 | Yokoyama | 400/175 |
| 5,751,327 | A * | 5/1998 | De Cock et al. | 347/130 |
| 6,055,006 | A * | 4/2000 | Murano | 347/118 |
| 6,169,564 | B1 * | 1/2001 | Tsukagoshi et al. | 347/238 |
| 6,252,619 | B1 * | 6/2001 | Ueda et al. | 347/138 |
| 6,366,304 | B1 * | 4/2002 | Nakayasu et al. | 347/129 |
| 6,469,728 | B1 * | 10/2002 | Charnitski et al. | 347/244 |
| 6,801,232 | B2 * | 10/2004 | Nagamine et al. | 347/149 |
| 6,809,752 | B2 * | 10/2004 | Nagamine | 347/238 |
| 7,061,518 | B2 * | 6/2006 | Ueda et al. | 347/242 |
| 7,154,525 | B2 * | 12/2006 | Oda et al. | 347/241 |
| 7,187,501 | B2 * | 3/2007 | Wakisaka | 359/622 |
| 7,264,857 | B2 * | 9/2007 | Berchtold et al. | 428/34.1 |
| 7,505,059 | B2 * | 3/2009 | Inoue et al. | 347/238 |
| 7,551,193 | B2 * | 6/2009 | Koike | 347/238 |
| 7,660,022 | B2 * | 2/2010 | Uematsu | 358/300 |
| 7,697,022 | B2 * | 4/2010 | Gomi | 347/241 |
| 7,804,511 | B2 * | 9/2010 | Honobe et al. | 347/149 |
| 7,825,946 | B2 * | 11/2010 | Sugiyama et al. | 347/242 |
| 8,040,368 | B2 * | 10/2011 | Yokoi | 347/242 |
| 8,068,762 | B2 * | 11/2011 | Yamaguchi | 399/110 |
| 2002/0149664 | A1 | 10/2002 | Nagamine et al. | |
| 2004/0135876 | A1 | 7/2004 | Ueda et al. | |
| 2005/0001896 | A1 | 1/2005 | Wakisaka | |
| 2007/0126852 | A1 * | 6/2007 | Fukutome et al. | 347/262 |
| 2008/0136333 | A1 * | 6/2008 | Fang | 315/149 |
| 2009/0027896 | A1 | 1/2009 | Nishimura et al. | |
| 2009/0116875 | A1 * | 5/2009 | Sugiyama et al. | 399/177 |

FOREIGN PATENT DOCUMENTS

| | | | |
|---|---|---|---|
| JP | 05-278266 | | 10/1993 |
| JP | 7-195734 | A | 8/1995 |
| JP | 10-063071 | | 3/1998 |
| JP | H11-198236 | A | 7/1999 |
| JP | 2002-361931 | | 12/2002 |
| JP | 2005-028606 | A | 2/2005 |
| JP | 2007-090675 | A | 4/2007 |
| JP | 2008-119022 | A | 5/2008 |
| WO | WO02/092349 | A1 | 11/2002 |
| WO | 2006/120858 | A1 | 11/2006 |

OTHER PUBLICATIONS

Extended EP Search Report dtd Nov. 11, 2009, EP Appln. 09166107.4.

JP Office Action dtd Aug. 3, 2010, JP Appln. 2008-216615, partial English Translation.

EP Office Action dtd Nov. 3, 2011, EP Appln. 09166107.4-1260.

EP Office Action dtd Jun. 18, 2012, EP Appln. 09166107.4-1260.

Notice of Reasons for Rejection for JP2008-188184 dated Apr. 2, 2013.

English Excerpts of Japanese Patent Application Laid-open No. 2005-28606, which was previously submitted to the USPTO on Feb. 9, 2010.

Notice of Reasons for Rejection of corresponding Japanese Patent Application No. 2008-188184 dated Jan. 7, 2014.

* cited by examiner

EXPOSURE DEVICE AND METHOD FOR PRODUCING THE SAME

CROSS REFERENCE TO RELATED APPLICATION

The present application claims priority from Japanese Patent Applications No. 2008-188184 filed on Jul. 22, 2008, No. 2008-216615 filed on Aug. 26, 2008 and No. 2008-216617 filed on Aug. 26, 2008, the disclosures of which are incorporated herein by reference in their entirety.

BACKGROUND OF THE INVENTION

1. Field of the Invention

The present invention relates to an exposure device (exposure apparatus) provided with a plurality of light-emitting sections (a plurality of blinking sections or intermittent light-emitting sections such as LED heads, etc.), and a method for producing the exposure device.

2. Description of the Related Art

An exposure member (for example, LED head (Light Emitting Diode head), etc.) which has a plurality of light-emitting sections arranged in a row and which expose a photosensitive or photoconductive body is conventionally used in an image-forming apparatus. Such an exposure device is provided with a light-emitting element such as LED, etc. and a casing which holds the light-emitting element. The exposure device needs to be subjected to positioning (subjected to positional adjustment) correctly with respect to the photosensitive body so that the exposure position with respect to the photosensitive body is accurate so as to form a satisfactory image. An exposure device in which a frame supporting a photoconductive drum (photoconductive body) is positioned with respect to an LED head (exposure member) by using a structure having a concave-convex shape, etc.

The exposure device which exposes the photoconductive drum is provided with an LED head having an LED, an lens array which forms an image (images) of a light emitted from the LED on the photoconductive drum as an erecting image, at ×1 magnification; and a housing which supports the LED and the lens array. The lens array includes GRIN lenses which are made of glass, which are gradient index lenses (each having refractive index gradient) and which are aligned in a row or in a plurality of rows; and the lens array is formed in an elongated shape extending in the axis direction of the photoconductive drum.

Further, the elongated lens array is arranged in the housing so as to protrude downward form the lower surface of the housing, and the lens array has the corner portions, on both ends in the longitudinal direction of the lens array, which are pointed substantially at a right angle.

Furthermore, in the above-mentioned exposure device, a spacer for maintaining the spacing distance, in the optical axis direction, between the LED head and the photoconductive drum is arranged between the LED head and the photoconductive drum. Conventionally, as an example of such image-forming apparatus, there is known an image-forming apparatus in which an eccentric cam is arranged between a plate-shaped spacer and the LED head to thereby finely adjust, with the eccentric cam, the spacing distance in the optical axis direction (hereinafter referred to as "optical axis-direction distance) between the photoconductive drum and the LED head.

In a case that, as in the above-mentioned exposure device, the frame supporting the photoconductive drum (photoconductive body) is to be positioned with respect to the LED head (exposure member) by using a structure having a concave-convex shape, etc., it is necessary to construct the casing of the LED head with high precision and with high rigidity. Therefore, it is hitherto necessary to produce the casing of the LED head with the aluminum die casting, etc. When the LED head is produced with such material and such producing method, then there is a problem such that the LED head becomes large-sized and the production cost becomes higher.

Moreover, even if a positioning portion with the concave-convex positioning structure is formed in the casing, it is not easy to fix (firmly fix) the light-emitting element to the casing and while maintaining a positional relationship between the light-emitting section of the light-emitting element and the positioning portion with high precision. Therefore, the positional relationship between the light-emitting section of the light-emitting element and the concave-convex positioning structure in the conventional apparatus has unsatisfactory or low precision, and there is a problem such that the positioning precision between the photoconductive body and the light-emitting section is low when the casing provided with the concave-convex positioning structure is simply assembled into other member or component.

Further, since the above-described LED head is used in the vicinity of or closely to the photoconductive drum, there is a fear that when the image-forming apparatus such as a printer is used for a long period of time, toner scattered from the photoconductive drum, etc. and/or paper powder generated from a paper sheet, etc. are attached or adhered to the lower surface of the lens array, which in turn lower the image quality. In this case, it is possible to remove the toner, etc. from the lower surface of the lens array by wiping the lower surface with a cloth or the like. However, when the corner portions on the both ends of the lens array are pointed or sharp, the cloth, etc. is caught or hooked by the corner portion(s), which in turn makes the cleaning operation with the cloth, etc. complicated. Moreover, when the cloth caught at the corner portion is torn and the fiber generated from the torn portion of the cloth is adhered to the lower surface of the lens array, there is a fear that the image quality is further lowered.

In addition, in the conventional technique (apparatus), the size of the eccentric cam and/or the spacer needs to be very small since the optical axis-direction distance is short, giving rise to the limitation to the precision in adjustment by the eccentric cam and the cam stroke. If such limitation is generated, it is not possible to set the optical axis-direction distance highly precisely, giving rise to a possibility that the image quality is lowered.

The inventors of the present application have developed a structure provided with a support frame which supports the LED head; a spacing distance-maintaining member (corresponding to the spacer) which maintains the spacing distance (distance) between the support frame and the photoconductive drum; and a cam which is arranged between the support frame and the LED head. With this structure, there is no need to provide any spacing distance-maintaining member or cam between the LED head and the photoconductive drum in the optical axis-distance which is short, thus solving the problems described above associated with the limitation to the precision in adjustment by the eccentric cam and the cam stroke and consequently the lowering of image quality.

However, with the above-described structure, when an excessive force is applied to the LED head upon, for example, cleaning the LED head, the LED warps with the cam as the warpage point and is elastically deformed in some cases. If the LED head is elastically deformed in such a manner, then the direction of the light emitted from the LED head is deviated from the normal direction, thus leading to a problem such that the image quality is lowered.

SUMMARY OF THE INVENTION

The present invention was made in view of such situation. A first object of the present invention is to provide an exposure device which is capable of performing exposure correctly at a desired exposure position.

A second object of the present invention is to provide an exposure device in which the cleaning operation of the lens array can be easily performed and the image quality can be satisfactorily maintained.

A third object of the present invention is to provide an exposure device which is capable of suppressing the deformation of the LED head (exposure member) to thereby improve the image quality.

According to a first aspect of the present invention, there is provided an exposure device including: an exposure head having a light-emitting member which has a plurality of light-emitting sections arranged in a row, and a casing which holds the light-emitting member and which is elongated in a longitudinal direction orthogonal to an optical axis direction of a light emitted from the light-emitting sections; and an elongated frame member fixed to the casing and having a reference portion at which the frame member is positioned with respect to the light-emitting sections; wherein the frame member is fixed to the casing such that the frame member is positioned with respect to the light-emitting sections in both of the longitudinal direction and a width direction of the casing, the width direction being orthogonal to the longitudinal direction and the optical axis direction.

According to such an exposure device, the exposure head and the frame member are fixed to each other such that the light-emitting sections and the reference portion are in a correct positional relationship. Therefore, even when the construction is adopted in which the exposure device is assembled successively into another member, such as a support member supporting the exposure device and the body of the image-forming apparatus, etc., it is possible to provide a correct positional relationship between the photoconductive body and the exposure device.

According to a second aspect of the present invention, there is provided a method for producing an exposure device which includes: an exposure head having a light-emitting member which has a plurality of light-emitting sections arranged in a row and a casing which holds the light-emitting member and which is elongated in a direction orthogonal to an optical axis direction of a light emitted from the light-emitting sections; and an elongated frame member fixed to the casing and having a reference portion at which the frame member is positioned with respect to the light-emitting sections, the method including: preparing the casing and the frame member, a plurality of projections being provided on one of the casing and the frame member and projecting toward the other of the casing and the frame member; coating a first adhesive onto the projections, and stacking the casing and the frame member and curing the first adhesive while the reference portion is positioned with respect to the light-emitting sections; adhering the casing and the frame member, with a second adhesive having an elastic coefficient after curing which is smaller than an elastic coefficient after curing of the first adhesive, at a portion of the casing and a portion of the frame member, the portions facing each other and different from the projections.

With such a method for producing the exposure device, it is possible to produce the above-described exposure device. Further, upon producing the exposure device, the positional relationship between the light-emitting sections and the reference portion is fixed (determined) by curing the first adhesive while the position of the reference portion is adjusted with respect to the light-emitting sections. Afterwards, by adhering the casing and the frame member with the second adhesive at a portion of the casing and a portion of the frame member which are different from the projections, it is possible to firmly fix the casing and the frame member with each other. Further, the second adhesive has elastic coefficient after curing which is smaller from that of the first adhesive. Therefore, the force exerting to and warping the casing and the frame member due to the shrinkage (contraction) of the second adhesive when the second adhesive is cured is relatively small, and thus preventing any inconvenience or problem which would be otherwise caused such that the positional relationship, between the light emitting sections and the reference portion with the first adhesive, obtained upon fixing the casing and the frame member with the first adhesive, is disarranged or degraded; and thus making it possible to maintain satisfactory positional relationship.

The exposure device of the present invention may further include: an elongated lens array which focuses the light emitted from the light-emitting sections; a housing which supports the lens array such that the lens array is projected outward from the housing; and covers which are made of resin and arranged on the lens array on both ends, respectively, in a longitudinal direction of the lens array, the covers each having a height flush with or higher than a light-exit surface of the lens array.

In this case, the covers are provided which are made of resin and arranged on the lens array on both ends, respectively, in the longitudinal direction of the lens array, the covers each having a height flush with or higher than the light-exit surface of the lens array. Therefore, at the time of cleaning, it is possible to prevent, with the covers, the cloths, etc. from being caught or hooked at a corner portion of the lens array.

Accordingly, it is possible to easily perform the cleaning operation for the lens array and to suppress the cloth, etc. from being torn, thereby making it possible to maintain the image quality satisfactorily.

The exposure device of the present invention may further include: a support frame which supports the exposure head; and two adjusting members which are arranged between the exposure head and the support frame to be away from each other in a longitudinal direction of the exposure head, and which adjust a spacing distance between the exposure head and the support frame; wherein a projection portion may be provided on one of the exposure head and the support frame at a portion between the two adjusting members, the projection portion projecting from one of the exposure head and the support frame toward the other of the exposure head and the support frame.

In this case, the projection portion is provided on one of the exposure head and the support frame at a portion between the two adjusting members, the projection portion projecting from one of the exposure head and the support frame toward the other of the exposure head and the support frame. Accordingly, even when any excessive force is applied to the exposure head and the exposure head attempts to warp with the two adjusting members as the warpage points, the projection portion and the support frame (or the exposure head) abut or come into contact with each other. Thus, it is possible to suppress the elastic deformation of the exposure head.

According to the exposure device of the present invention, it is possible to expose the photoconductive body, etc. correctly since the light-emitting sections and the reference portion are in a correct positional relationship. Further, the correct positional relationship between the light-emitting sections and the reference portion makes it possible to complete the production of the image-forming apparatus, etc. only by assembling the exposure device into other member or components of the image-forming apparatus, thereby making it possible to omit any additional step which would be otherwise required for positioning and thus to lower the cost for producing the image-forming apparatus.

Since the covers which are made of resin and each of which has the height flush with or higher than the light-exit surface of the lens array are arranged on the lens array on both ends, respectively, of the lens array, it is possible to easily perform the cleaning of the lens array and to maintain the image quality satisfactorily.

According to the present invention, the projection portion is provided on one of the exposure head and the support frame, the projection portion projecting from one of the exposure head and the support frame toward the other of the exposure head and the support frame. Accordingly, it is possible to suppress, with the projection portion, the elastic deformation of the exposure device and to improve the image quality.

DESCRIPTION OF THE PREFERRED EMBODIMENTS

First Embodiment

Figure 1:
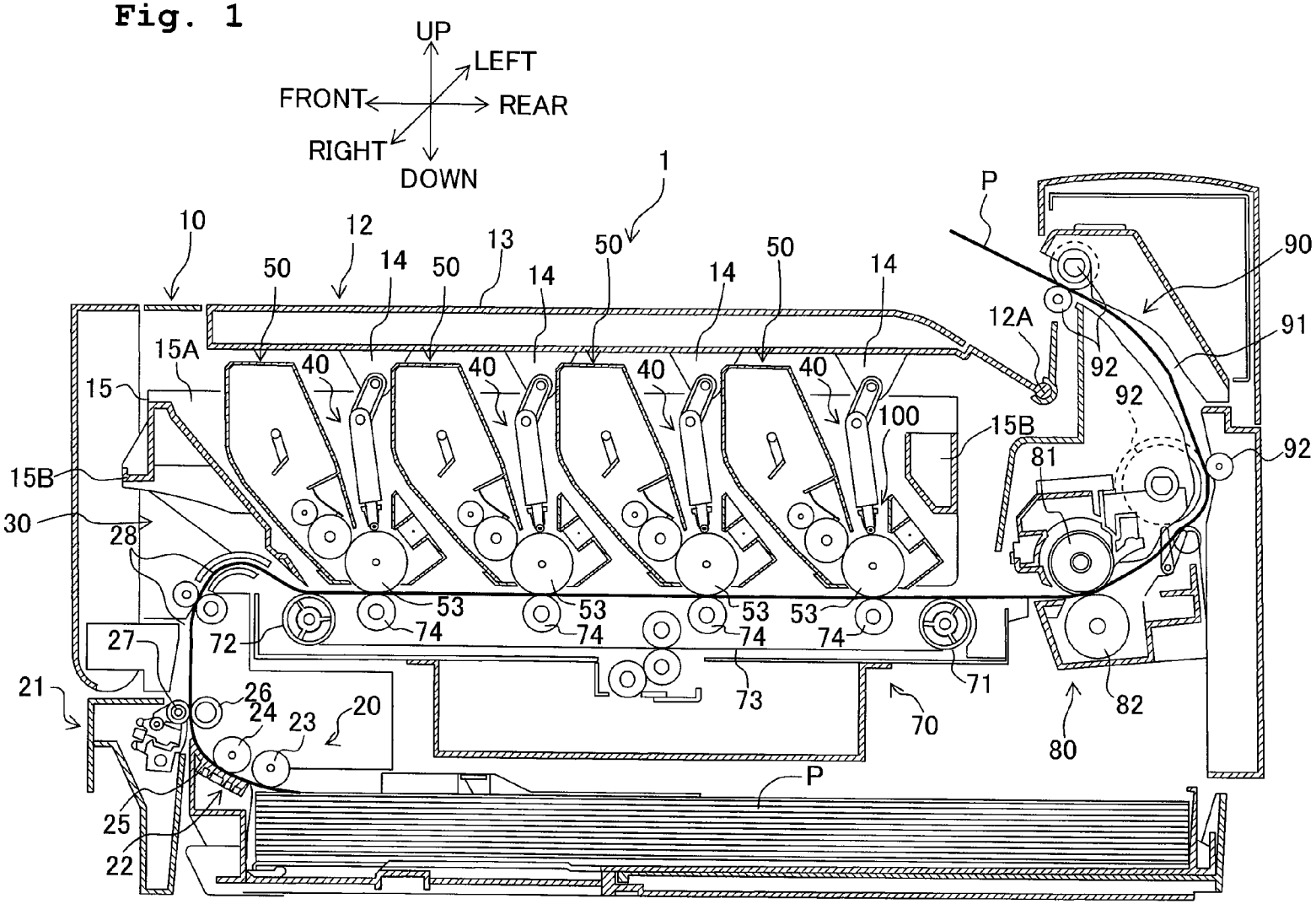
FIG. 1 is a cross-sectional view of the overall construction of a color printer as an example of image forming apparatus in which an exposure device of the present invention is applied.

In the following, a detailed explanation will be given about a first embodiment of the present invention, while appropriately referring to the drawings.

The following explanation will be given with the directions with a user when using the color printer as the reference. Namely, in FIG. 1, the left side on the sheet surface is "front side"; the right side on the sheet surface is "rear side"; the far side on the sheet surface is "left side"; and the front side on the sheet surface is "right side". Further, the up and down direction in the sheet surface is "up and down direction".

As shown in FIG. 1, a color printer 1 adopting the exposure device of the present invention is provided with, in a housing 10 of the body of the color printer (body housing 10), a paper feeding section 20 which feeds a sheet of paper P (paper sheet P; paper P), an image forming section 30 which forms an image on the paper P fed from the paper feeding section 20, and a paper discharging section 90 which discharges the paper P on which an image is formed by image forming section 30.

An upper cover 12 which is openable/closable with respect to the body housing 10 is provided on an upper portion of the body housing 10. The upper cover 12 is provided on the body housing 10 to be pivotable in the up and down direction with a hinge 12A arranged on the rear side of the upper cover 12 as the pivot point. The upper surface of the upper cover 12 is a discharged paper tray 13 in which the paper P discharged from the body housing 10 is accumulated; and a plurality of LED-attachment members 14 supporting LED units 40 respectively are arranged in the lower surface of the upper cover 12.

Further, a frame 15 of the body housing (body frame 15) is arranged in the body housing 10. The body frame 15 accommodates process cartridges 50 such that each of the process cartridges 50 is detachable with respect to the body frame 15. The body frame 15 is provided with a pair of side plates 15A (only a side plate 15A on one side is shown in the drawing) arranged on the right and left sides, respectively, and a pair of cross members 15B arranged on the front and rear sides, respectively and linking the pair of side plates 15A. The body frame 15 is fixed to the body housing 10, etc. The side plates 15A are arranged at the both ends, respectively, in an arrangement direction in which light-emitting sections of an LED exposure device 100 are arranged (to be described later on). The side plates 15A are a member supporting a photoconductive drum 53 directly or indirectly and positioning the photoconductive drum 53.

The paper feeding section 20 is arranged in the body housing 10 at the lower portion of the body housing 10, and includes a paper feed tray 21 which is attached detachably to the body housing 10, and a paper supply mechanism 22 which supplies the paper P from the paper feed tray 21 to the image forming section 30. The paper supply mechanism 22 is arranged in the front side of the paper feed tray 21, and is mainly provided with a paper feed roller 23, a separation roller 24 and a separation pad 25.

In the paper feeding section 20, sheets of the paper P in the paper feed tray 21 are separated one by one and fed upward, and paper powder on the paper P is removed while passing between a paper-powder removing roller 26 and a pinch roller 27; and then the paper P is turned (flipped) backward while travelling on a transport path 28, and is supplied to the image forming section 30.

The image forming section 30 is mainly constructed of four pieces of LED unit 40, four pieces of process cartridge 50, a transfer unit 70 and a fixing unit 80.

Figure 2:
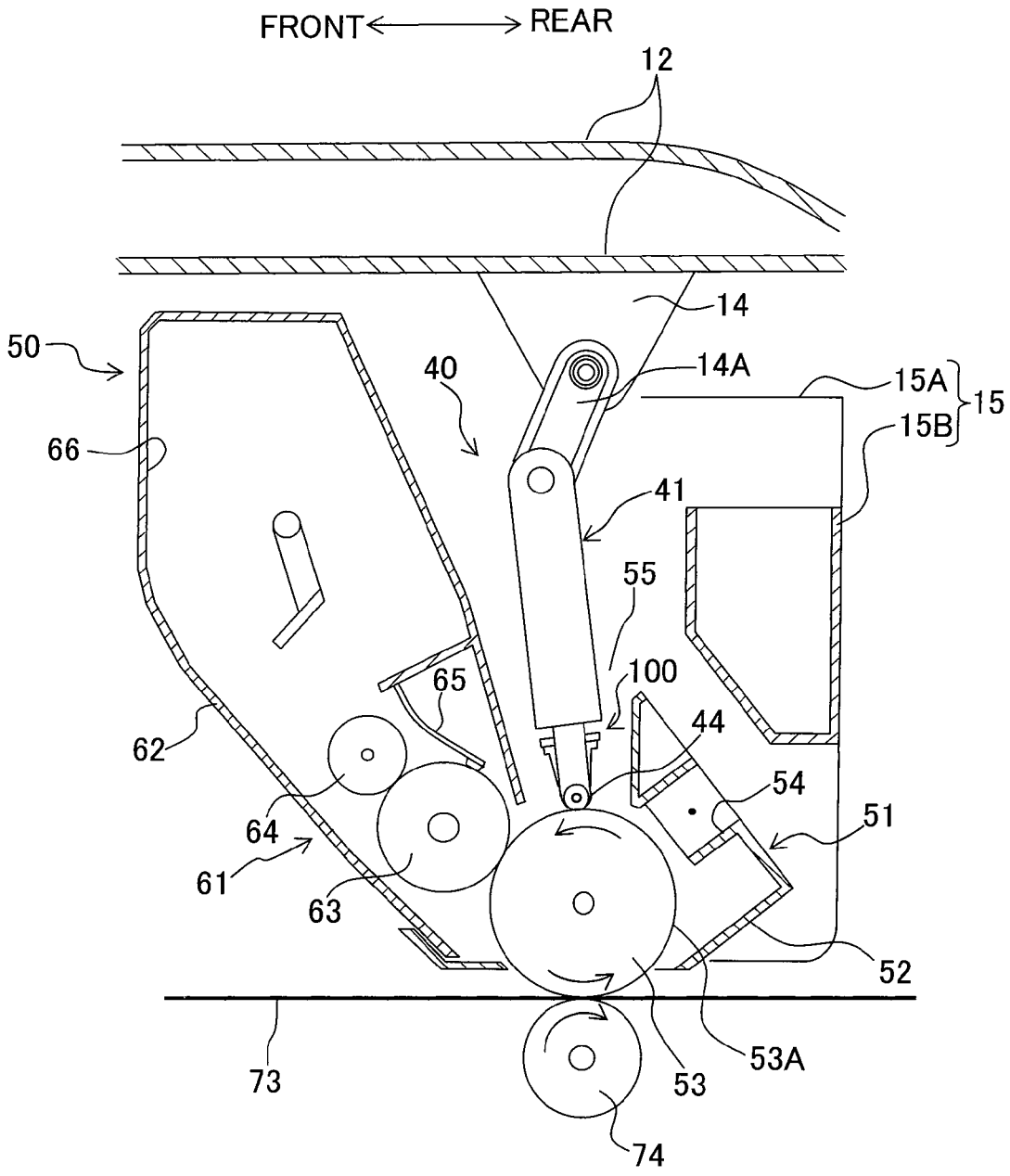
FIG. 2 is an enlarged view of an LED unit and a process cartridge shown in FIG. 1.

The process cartridges 50 are arranged between the upper cover 12 and the paper feeding section 20 to be aligned in a row in the front/rear direction. As shown in FIG. 2, each of the process cartridges 50 is provided with a drum unit 51, and a developing unit 61 which is detachably attached to the drum unit 51. Each of the process cartridges 50 is supported by the side plates 15A, and a photoconductive drum 53 is supported by each of the process cartridges 50. Note that the process cartridges 50 have a same construction except that the color of toner accommodated in a toner accommodation chamber 66 of the developing unit 61 are different among the process cartridges 50.

The drum unit 51 is mainly provided with a drum frame 52, a photoconductive drum 53 as an example of the photoconductive body which is rotatably supported by the drum frame 52, and a scorotron charger 54.

The developing unit 61 is provided with a developing frame 62, a developing roller 63 and a supply roller 64 which are rotatably supported by the developing frame 62, and a layer-thickness regulating blade 65. The toner accommodating chamber 66 which accommodates the toner is formed in the developing unit 61. In the process cartridge 50, the developing unit 61 is attached to the drum unit 51 to thereby form an exposure hole 55, between the developing frame 62 and the dram frame 52, in which the photoconductive drum 53 is visible from above. The LED unit 40 is inserted into the exposure hole 55. The LED unit 40 will be explained in detail later.

As shown in FIG. 1, the transfer unit 70 is arranged between the paper feeding section 20 and the process cartridges 50, and is constructed to mainly include a driving roller 71, a driven roller 72, a transport belt 73 and a transfer roller 74.

The driving roller 71 and the driven roller 72 are arranged to be parallel and away from each other in the front/rear direction. The transport belt 73 formed of an endless belt is arranged to be stretched between the driving roller 71 and the driven roller 72. The transport belt 73 makes contact with the respective photoconductive drums 53 on the outer surface of the transport belt 73. On the inner surface side of the transport belt 73, four pieces of the transfer roller 74 are arranged to be opposite to (to face) the photoconductive drums 53, respectively. The transfer rollers 74 pinch and hold the transport belt 73 between the transport rollers 74 and the photoconductive drums 53 respectively. Upon performing the transfer, transfer bias is applied to the transport rollers 74 by constant current control.

The fixing unit 80 is arranged in the body housing 10 on the rear side with respect to the process cartridges 50 and the transfer unit 70, and is provided with a heating roller 81 and a pressure roller 82 which is arranged facing the heating roller 81 and which presses the heating roller 81.

In the image forming section 30 as constructed above, at first, the surface of each of the photoconductive drums 53 is uniformly charged by the scorotron charger 54, and then is exposed with an LED light emitted from one of the LED units 40. With this, the electric potential is lowered on each of the photoconductive drums 53 at the exposed portion thereof, and an electrostatic latent image based on an image data is formed on each of the photoconductive drums 53.

Further, the toner in the tonner accommodating chamber 66 is supplied to the developing roller 63 by the rotation of the supply roller 64; and the supplied toner is advanced and made to enter between the developing roller 63 and the layer-thickness regulating blade 65 and is held on the developing roller 63 as a thin layer having a predetermined thickness.

When the developing roller 63 is facing and is brought in contact with the photoconductive drum 53, the toner held on the developing roller 63 is supplied to the electrostatic latent image formed on the photoconductive drum 53. With this, the toner is selectively held on the photoconductive drum 53 to make the electrostatic latent image be visualized (made as visible image), and a toner image is formed by reversal development.

Next, paper P supplied on the transport belt 73 is made to pass between each of the photoconductive drums 53 and one of the transfer rollers 74 arranged on the inside of the transport belt 73, thereby transferring the tonner image formed on each of the photoconductive drums 53 onto the paper P. Afterwards, the paper P is made to pass between the heating roller 81 and the pressure roller 82, thereby thermally fixing, on the paper P, the tonner image transferred onto the paper P.

The paper discharging section 90 mainly includes a paper-discharge side transport path 91 which is extended upward from the outlet (outlet port) of the fixing unit 80 and is formed to be turned (flipped) backward toward the front side and a plurality of pairs of transport rollers 92 which transport the paper P. The paper P, on which the tonner image is transferred and thermally fixed, is transported on the paper-discharge side transport path 91 by the transport rollers 92, is discharged to the outside of the body housing 10, and is accumulated in the discharged paper tray 13.

Construction of the LED Unit

Next, the construction of the LED unit 40 will be explained in detail.

Figure 3:
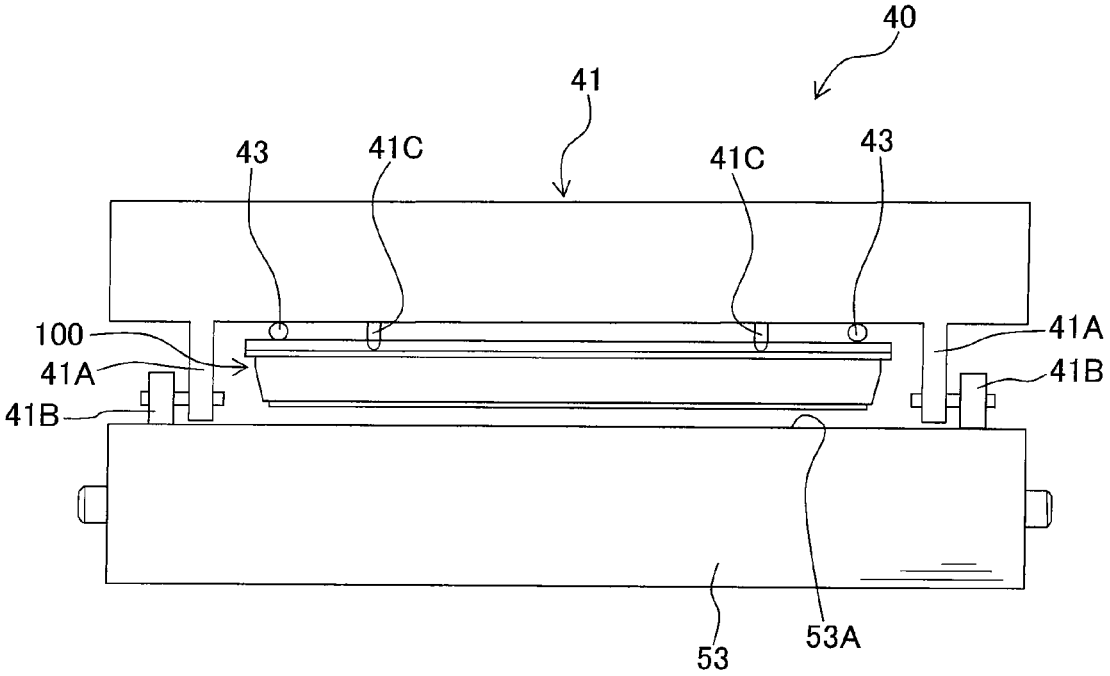
FIG. 3 is a view of the LED unit and a photoconductive drum seen from the front side.

As shown in FIG. 3, the LED unit 40 is constructed to include an LED exposure device 100 as an example of the exposure device, and a head supporting member 41.

Figure 4:
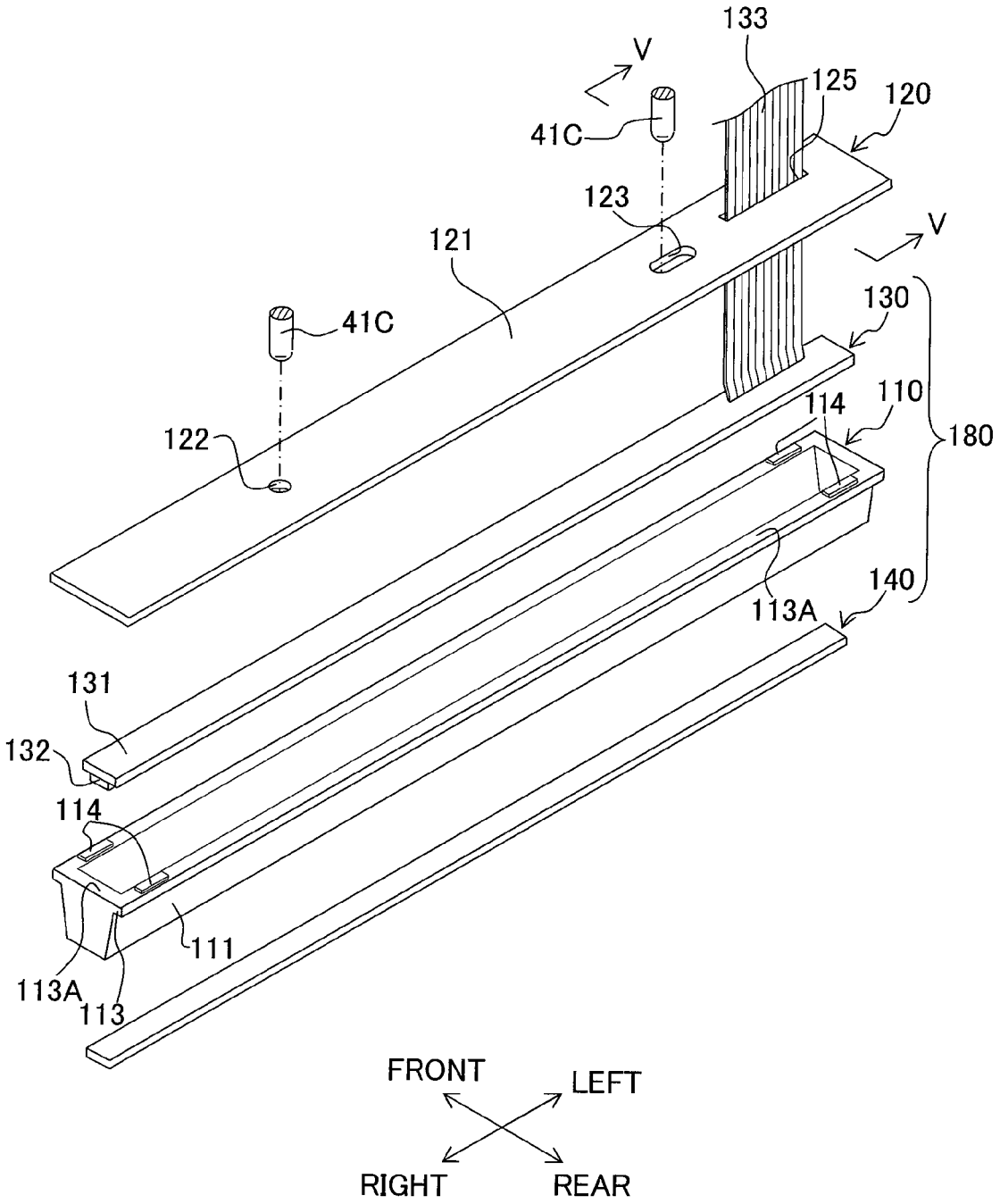
FIG. 4 is an exploded perspective view of the LED exposure device.

As shown in FIG. 4, the LED exposure device 100 includes a casing 110, a plate member 120 as an example of the frame member, a LED circuit board (LED wiring board) 130 as an example of the light-emitting member, and a lens array 140. A member constructed by assembling the casing 110, the LED circuit board 130 and the lens array 140 is an LED head 180 as an example of the exposure head.

Figure 5:
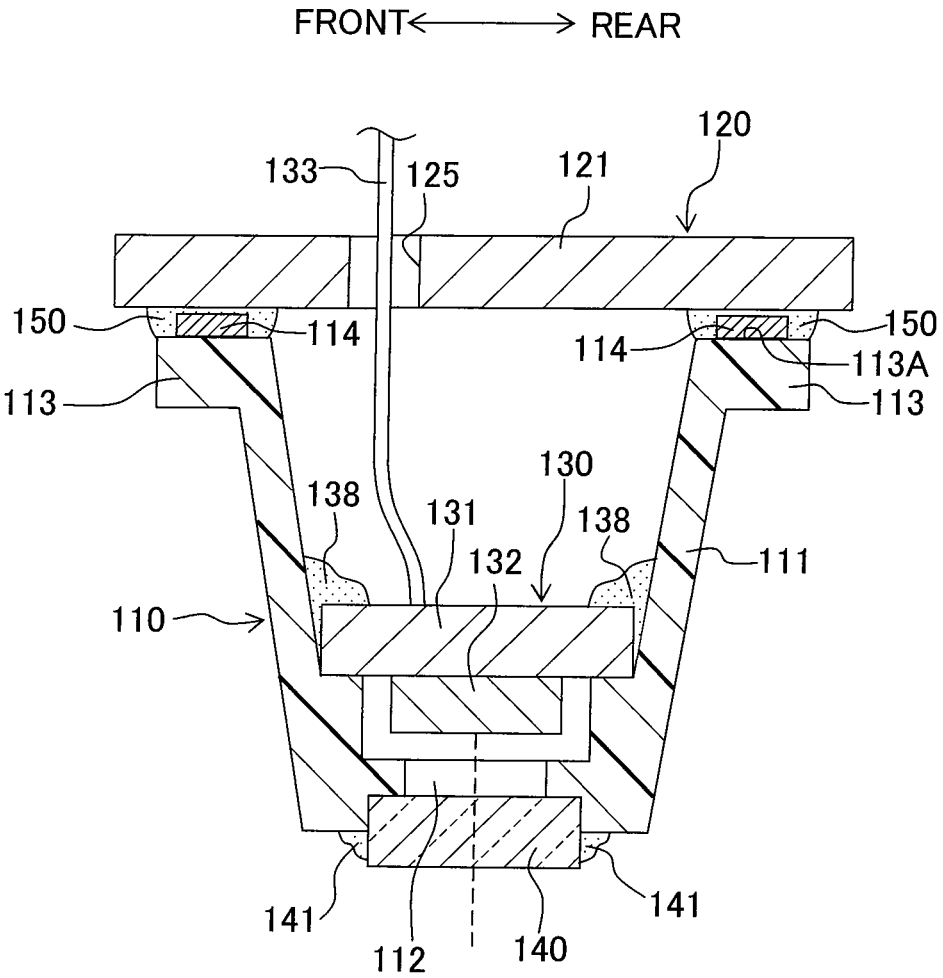
FIG. 5 is a sectional view taken along a line V-V in FIG. 4.

The casing 110 has a body 111 of the casing (case body 111) which is made of resin in a shape elongated in the right and left direction, and an opening is formed in the case body 111 at an upper portion of the case body 111. As shown in FIG. 5, an opening 112 is formed in the case body 111 at a lower portion of the case body 111. The opening 112 allows a light emitted from an LED array 132, of the LED circuit board 130, to pass through the opening 112. Edge portions at the upper end of the case body 111 forms a flange 113 extending outward in the front/rear direction of the case body 111. The upper surface of the flange 113 and the upper surface of edge portions, of the case body 111, in the left/right direction are, as will be described later on, is an adhesion surface 113A to be adhered to the plate member 120 with an adhesive 150 (first adhesive 151 and second adhesive 152).

Two pieces of a projection 114 are formed in the adhesion surface 113A at each of the both ends in the longitudinal direction of the adhesion surface 113A. Each of the projections 114 is projected upward, namely toward the plate member 120. To explain in more detail, the projection 114 is arranged in the flange 113 at each of the end portions in the longitudinal direction of the flange 113, so that the projections 114 are provided on the flange 113 both at the front and rear sides, respectively. When the casing 110 is adhered to the plate member 120, the four projection 114 are brought into contact with the plate member 120 and serve as portions (positioning portions) determining a relationship between the orientation of the plate member 120 and the orientation of the casing 110. Note that, as will be described later on, the adhesive 150 is coated on the projections 114. Accordingly, the projections 114 are brought into contact with the plate 120 via the adhesive 150.

As shown in FIG. 4, the plate member 120 is provided with an elongated metal plate (plate body 121) which covers the upper portion of the casing 110 (case body 111). In the plate body 121 of the plate member 120, reference holes 122 and 123 as an example of the reference portion, and a wiring hole 125 are formed by the press working. As shown in FIG. 5, the plate member 120 is formed to have a width greater than the width of the casing 110. Here, the term "width of the plate member 120 (width of the casing 110)" means a width of the plate member 120 (casing 110) in the front/rear direction which is orthogonal to the optical axis of the light emitted from the LED array 132 (to be described later on) and orthogonal to the longitudinal direction of the plate member 120 (casing 110). Since the width of the plate member 120 is greater than the width of the casing 110, the adhesion surface 113A (see FIG. 4) of the casing 110 faces (is opposite to) the plate member 120 even if the plate member 120 is shifted in the width direction to some extent with respect to the casing 110. This makes it possible to perform the positional adjustment in the width direction of the casing 110.

In this embodiment, the plate member 120 is not provided with any mechanical engagement to be positioned with respect to the casing 110 (LED head 180). Before the plate member 120 is fixed (firmly fixed) to the casing 110, the plate member 120 is freely movable in a plane, which is orthogonal to the optical axis of the light emitted from the LED head 180, at least in a range for allowing the positional adjustment with respect to the casing 110. However, note that with respect to the longitudinal direction of the LED head 180, if the LED elements are arranged in an area (range) broader than an image formation range (area) of image to be formed on the paper P, then the exposure can be performed in an appropriate exposure range by adjusting the signal to be transmitted to the LED head 180. Therefore, it is allowable to perform the positioning with respect to the longitudinal direction of the LED head 180 by a mechanical engagement between the plate member 120 and the casing 110 (LED head 180). Accordingly, it is allowable that the plate member 120 and the LED head 180 are in a relationship such that the plate member 120 and the LED head 180 are movable relative to each other in a range in which the positional adjustment between the plate member 120 and the LED head 180 can be performed at least regarding the width direction of the LED head 180.

In a case that the plate body 121 is made of a metal plate, it is possible to lower the production cost and to obtain such a rigidity of the plate body 121 that the plate body 121 sufficiently reinforces the casing 110. In addition, an effect can be obtained to shield electromagnetic wave generated from the LED circuit board 130. It is possible to use, as the material for forming the plate body 121, iron, aluminum alloy, etc. However, it is also possible to use a material other than the iron, aluminum alloy, etc., a material such as hard resin, FRP, ceramics or the like.

As shown in FIG. 4, the reference hole 122 on the right side is a circular hole, and the reference hole 123 on the left side is a long hole elongated in the longitudinal direction of the plate member 120. The reference holes 122 and 123 each serve as a positioning portion into each of which a positioning pin 41C of the head supporting member 41 is fitted to thereby position the head supporting member 41 and the LED exposure device 100 with each other. Since the reference hole 123 is a long hole, it is possible to absorb or tolerate the size change such as the expansion or contraction due to the temperature change in the LED exposure device 100 and the head supporting member 41.

The LED circuit board 130 is provided with a circuit board 131, an LED array 132 arranged on the circuit board 131, and a harness 133. The circuit board 131 is arranged inside the casing 110 in a state that the LED array 132 is oriented downward, and is adhered and fixed to the case body 111. The LED array 132 is a public known element in which a plurality of light-emitting sections made of LED elements is arranged (aligned) in a row. Although not shown, the plurality of light-emitting sections is aligned in a row or a plurality of rows, and in each of the rows of the light-emitting sections, the light-emitting sections are arranged in the longitudinal direction of the casing 110. The direction of the optical axis of the light emitted from the light-emitting sections of the LED array 132 is orthogonal to the in-plane (planar) direction of the plate member 120.

The harness 133 is a wire which is connected to a controller (not shown) of the color printer 1 and which transmits, to the LED circuit board 130, a signal corresponding to the image to be printed.

The lens array 140 is a public known lens which images (forms, as an image,) the light emitted from the LED array 132 on a photoconductive surface 53A (see FIG. 3) of the photoconductive drum 53. As shown in FIG. 5, the lens array 140 is positioned (placed) in the opening 112 of the casing 110 and is adhered to the casing 110 with an adhesive 141.

The head supporting member 41 is a member which supports the LED exposure device 100 from above (from the upper side of) the LED exposure device 100. As shown in FIG. 2, the head supporting member 41 is attached to the LED-attachment member 14 via a link 14A. As shown in FIG. 3, the head supporting member 41 has two roller support portions 41A which extend downward from both ends, respectively, in the left/right direction of the body of the head supporting member 41; and rollers 41B provided on the two roller support portions 41A, respectively. The rollers 41B are rolled on the circumferential surface of the photoconductive drum 53, at a portion adjacent to the photoconductive surface 53A, and serve as a spacing distance-maintaining member for maintaining the spacing distance (distance) between the LED array 132 and the photoconductive surface 53A of the photoconductive drum 53. Further, the head supporting member 41 is provided with two pieces of the positioning pin 41C extending downward. As described above, the two positioning pins 41C have a function to position the head supporting member 41 and the LED exposure device 100 with each other, by being fitted to the reference holes 122, 123, respectively. Furthermore, eccentric cams 43 are provided on the head supporting member 41 each at a portion between the head supporting member 41 and the LED exposure device 100, so as to make it possible to adjust the distance between the LED exposure device 100 and the head supporting member 41. A detailed explanation of the construction for fixing the LED exposure device 100 to the head supporting member 41 will be omitted.

Figure 6A:
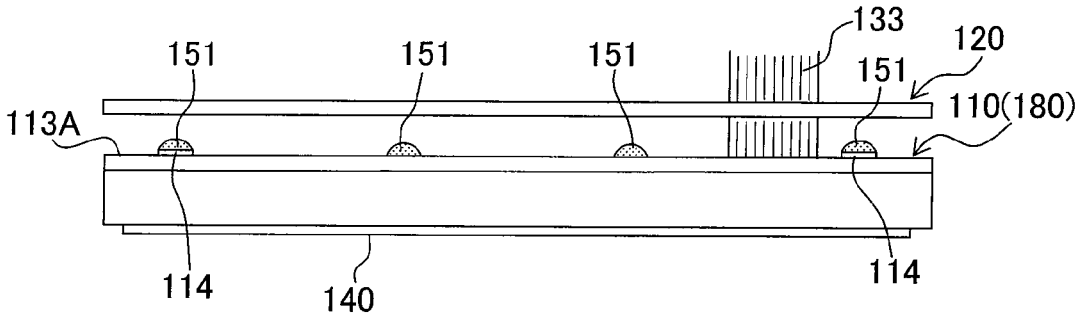
FIG. 6 (FIGS. 6A to 6D) is a view for explaining assembling process for the LED exposure device.

Next, an explanation will be given about a method for producing the LED exposure device 100. As shown in FIG. 6A, an LED head 180 is prepared in which the LED circuit board 130 and the lens array 140 are adhered to the casing 110. Then, the first adhesive 151 is coated (applied) on the projections 114 on the adhesion surface 113A of the casing 110, the projections 114 being arranged on the adhesion surface 113A at four positions, respectively, and on the adhesion surface 113A at two inner portions located inside, with respect to the projections 114, in the longitudinal direction of the adhesion surface 113A. Note that with respect to the inner portions as described above, since the first adhesive 151 are coated on the both flanges in the front and rear sides, the adhesive 151 is coated on the inner portions at four positions in total. The first adhesive 151 is a public known photocurable resin. Then, the harness 133 is passed through the wiring hole 125 of the plate member 120.

Figure 6B:
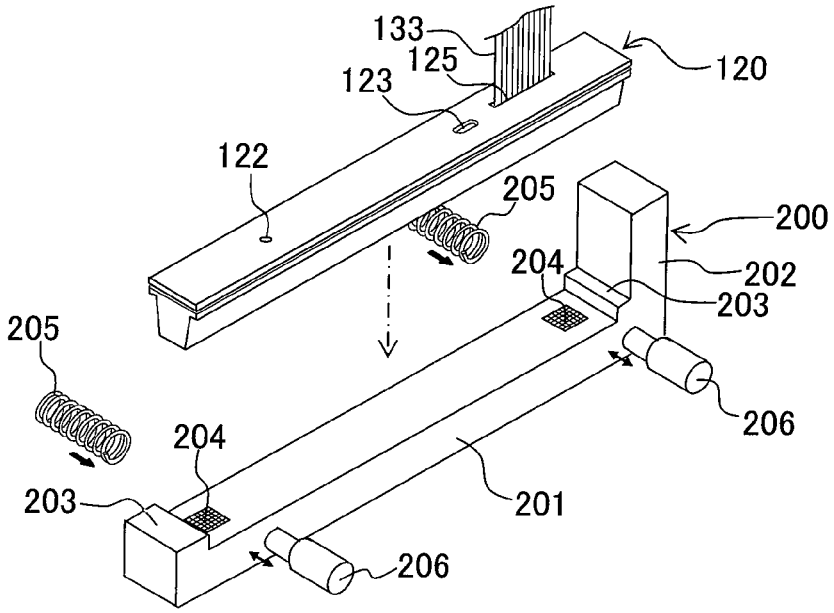
Figure 6C:
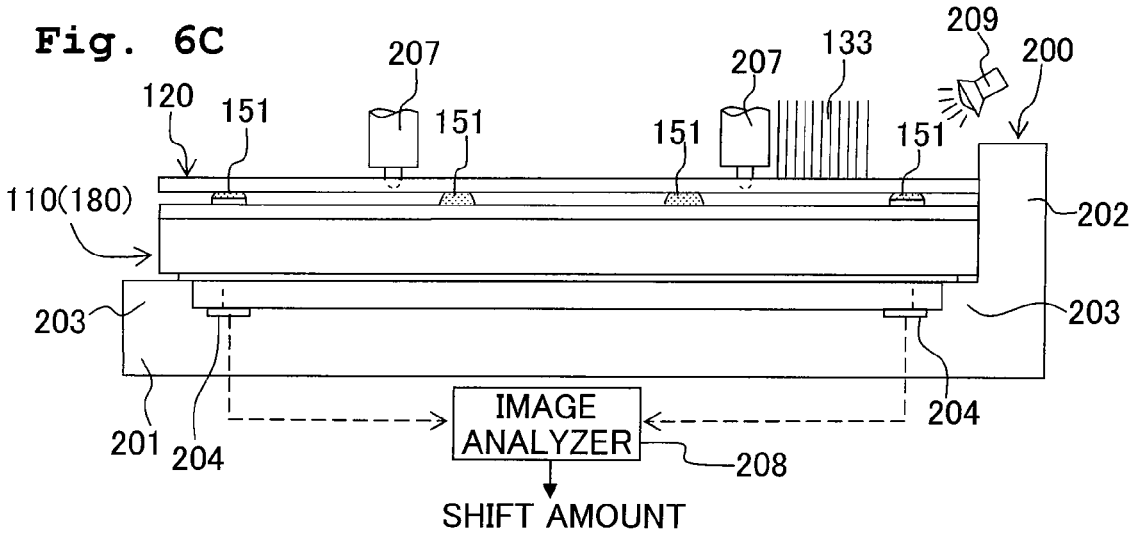

Afterwards, as shown in FIG. 6B, a positioning jig 200 is used to subject the casing 110 and the plate member 120 to the positional adjustment (positioned with each other). Here, an explanation will be given about the positioning jig 200. The positioning jig 200 has an elongated measurement stand 201, and a side wall 202 extending upward from one end of the measurement stand 201. In the positioning jig 200, placement portions 203 on which the casing 110 is to be placed are formed on the upper surface of the measurement stand 201, at both end portions of the upper surface, respectively, to project upward from the both end portions. Further, a CCD (Charge Coupled Device) 204 is provided on the upper surface of the measurement stand 201 at a portion slightly located on the inner side with respect to each of the placement portions 203. Moreover, springs 205 and micrometer heads 206 are provided in the vicinity of the both ends, of the measurement stand 201, in the longitudinal direction of the measurement stand 201, with the measurement stand 201 being intervened between the springs 205 and the micrometer heads 206 such that the springs 205 are arranged on the one side of the measurement stand 201 and the micrometer heads 206 are arranged on the other side of the measurement stand 201 to face or be opposite to the springs 205, respectively. Namely, two pairs of the springs 205 and micrometer heads 206 are arranged on the sides of the measurement stand 201. The springs 205 and the micrometer heads 206 are arranged at a spacing distance such that the springs 205 and the micrometer heads 206 can sandwich and hold the casing 110 placed on the placement portions 203. Further, as shown in FIG. 6C, support tools 207 are provided which fix the position of the plate member 120 during the positional adjustment (positioning).

Upon adhering the casing 110 and the plate member 120, the casing 110 is placed on the placement portions 203 of the positioning jig 200, and make the casing 110 be sandwiched and held by the springs 205 and the micrometer heads 206. Then, the casing 110 is moved toward the side wall 202 so as to bring the casing 110 into contact with (to abut the casing 110 on) the side wall 202. Further, the plate 120 is fixed at a certain position by fitting the support tools 207 to the references holes 122, 123.

In this state, a predetermined signal is transmitted to the LED circuit board 130 to cause a certain LED element at a predetermined position in the LED array 132 to emit light. The CCD 204 receives the light emitted from the certain LED element. The light received by the CCD 204 is outputted to an image analyzer 208 as shown in FIG. 6C, and a shift amount (deviation amount) of the position of the casing 110, with respect to the plate member 120, in the front/rear direction (width direction) is calculated and outputted by the image analyzer 208. Namely, the light emitted from the certain LED element is received by a certain pixel of the CCD 204. Then, a shift amount between the certain pixel receiving the light and a predetermined pixel in the front/rear direction is outputted. Depending on the shift amount, the micrometer heads 206 are operated manually or by feedback control, to thereby adjust the position of the casing 110 in the front/rear direction. In such a manner, the positional relationship is adjusted for the light-emitting sections of the LED array 132 provided on the casing 110 and the reference holes 122, 123 of the plate member 120. After the adjustment is completed, the first adhesive 151 is cured by a UV light irradiated from a UV radiation device 209.

Figure 6D:
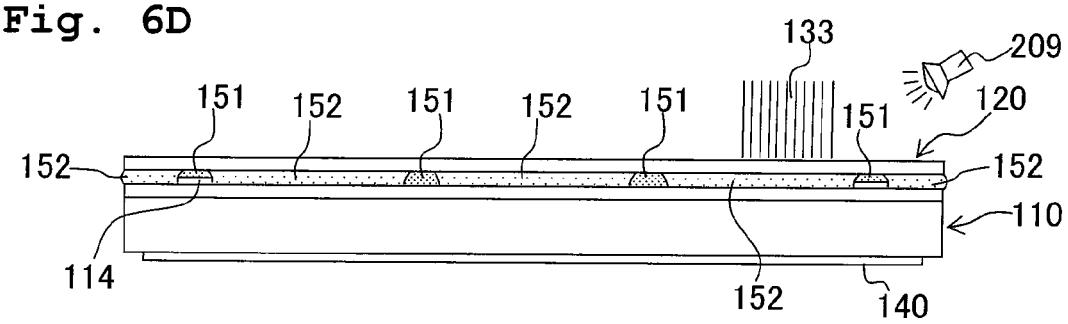
Figure 7:
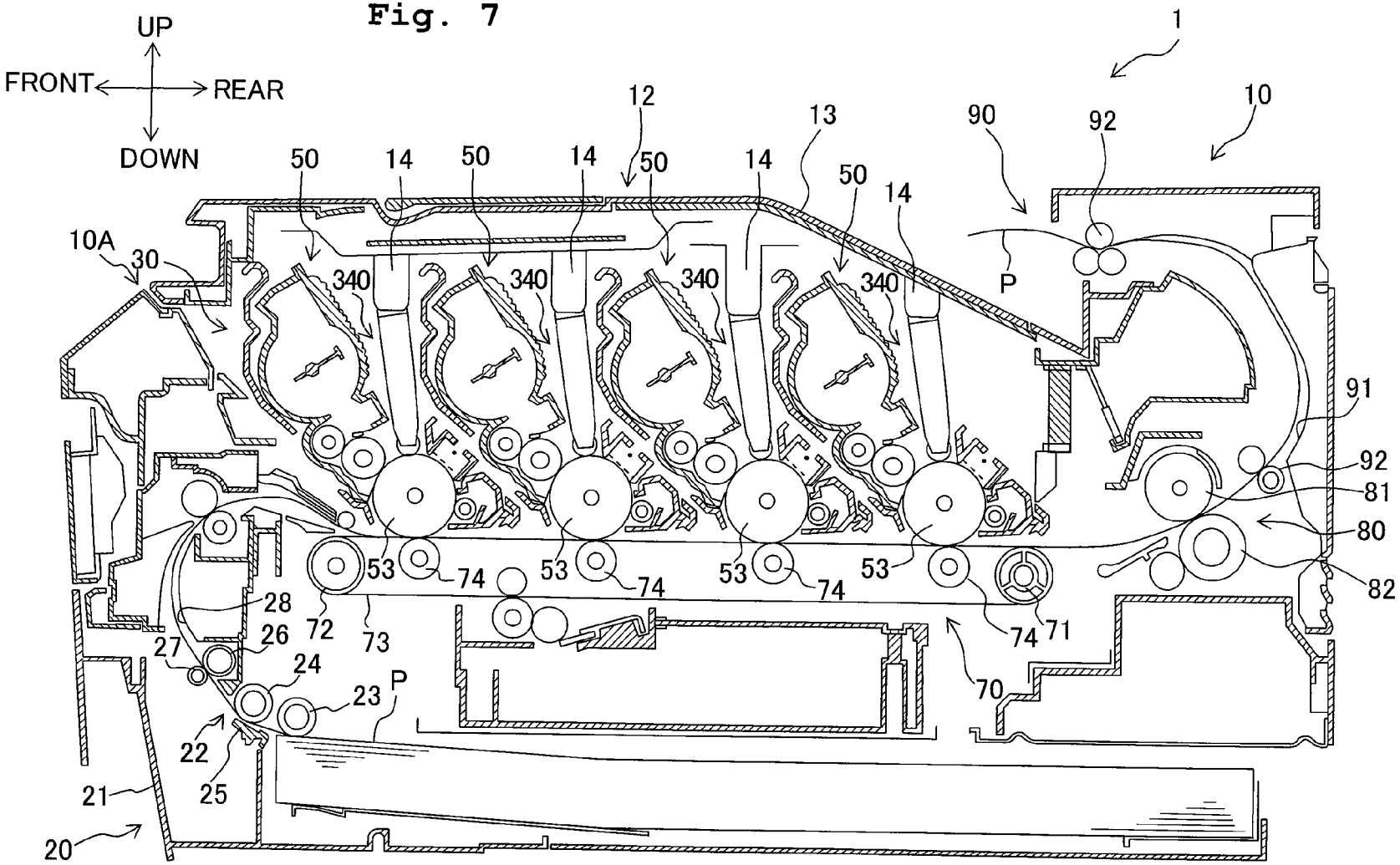
FIG. 7 is a cross-sectional view of the overall construction of another color printer as an example of image forming apparatus.

By curing the first adhesive 151, the casing 110 and the plate member 120 are positioned (positionally adjusted) and fixed to each other. Further, for firmly fixing the casing 110 and the plate member 120, and for preventing any dirt, dust, etc. from entering into the casing 110, the second adhesive 152 is coated on the casing 110 and the plate member 120 at the entire circumference of a portion of the casing 110 and at the entire circumference of a portion of the plate member 120, the portions facing with each other, in such a manner that the second adhesive 152 is infiltrated (permeated) in a gap between the casing 110 and the plate member 120, as shown in FIG. 6D. Specifically, in a case that the second adhesive 152 is a liquid adhesive (having a low viscosity), the second adhesive 152 may be injected or poured directly toward the gap between the casing 110 and the plate member 120. Alternatively, the second adhesive 152 may be poured into the gap between the casing 110 and the plate member 120 by using a spatula, etc. Then, the UV light is irradiated again from the UV radiation device 209 to thereby cure the second adhesive 152. Here, it is preferable to use, as the second adhesive 152, an adhesive having an elastic coefficient after curing which is smaller than that of the first adhesive 151. In this case, even if the first adhesive 152 is shrank or contracted when being cured, the force generated by the shrinkage of the second adhesive 152 and affecting to warp (change, compromise) the positional relationship between the casing 110 and the plate member 120 is weaker than the fixing force of the first adhesive 151. For this reason, the positional relationship between the casing 110 and the plate member 120 fixed by the first adhesive 151 is not disarranged or deteriorated.

With respect to the LED exposure device 100 which is assembled in such a manner, the positioning pins 41C of the head supporting member 41 are fitted to the references holes 122, 123 respectively as shown in FIG. 3, and is subjected to focus adjustment by the adjustment of the eccentric cams 43. Then, as shown in FIG. 1, each of the LED exposure devices 100 is attached to the upper cover 12 via one of the LED-attachment members 14.

In such a manner, the LED exposure device 100 is accurately positioned, with respect to the head supporting member 41, by the reference holes 122, 123. Further, for example, by mechanically engaging the head supporting member 41 to the body frame 15, the LED exposure device 100 is positioned (positionally-adjusted) with respect to the photoconductive drum 53 at the same time when the upper cover 12 is closed. As described above, the positional relationship between the LED exposure device 100 and the photoconductive drum 53 is fixed accurately. Thus, it is possible to form a satisfactory image in the color printer 1.

As explained above, according to the LED exposure device 100 used in the color printer 1 of the present embodiment, the following effects can be obtained. Namely, in the LED exposure device 100, the plate member 120 which has an elongated shape and which is provided with the reference holes 122, 123 for positioning, is firmly fixed in a state that the plate member 120 is positioned, with respect to the light-emitting sections of the LED array 130, in the width direction and longitudinal direction of the plate member 120 which are orthogonal to the optical axis of the light emitted from the light-emitting sections of the LED array 130. Therefore, even when a construction is adopted in which the LED exposure devices 100 are successively assembled into (with respect to) the head supporting members 14, etc., it is possible to obtain accurate positional relationship between the photoconductive drums 53 and the LED exposure devices 100.

Further, since the casing 110 is made of resin, it is possible to make the thickness of the casing 110 to be thin, thereby making it possible to realize a small-sized color printer 1. Furthermore, since the plate member 120 is adhered to the casing 110 to form an integrated body such that the plate member 120 closes the casing 110, it is possible to obtain sufficient rigidity while realizing a small-sized LED exposure device 100.

Since the plate member 120 is made of metal, it is possible to obtain sufficient rigidity for the LED exposure device 100, while shielding electromagnetic wave generated from the LED circuit board 130 to thereby suppress the influence due to the electromagnetic wave to other device or component in the color printer 1.

Moreover, since the plate member 120 has a size in the width direction thereof greater than that of the casing 110, it is possible to securely obtain adjustment margin for the plate member 120 with respect to the casing 110 in the width direction of the plate member 120, thereby making it possible to secure the fixing force between the plate member 120 and the casing 110 after the positional adjustment.

Since the plate member 120 is provided with the wiring hole 125 through which the harness for supplying signal to the LED circuit board 130 is passed, the harness can be wired without lowering the rigidity of the plate member 120.

The casing 110 and the plate member 120 are adhered to each other with the adhesive 150, and the adhesive 150 is coated on the entire circumference of the portion of the casing 110 and is coated on the entire circumference of the portion of the plate member 120, the portions facing each other (are opposite to each other). Accordingly, the casing 110 and the plate member 120 are fixed firmly, thereby making it possible to obtain the rigidity for the LED exposure device 100 and to prevent any dirt, dust, etc. from entering into the casing 110 as well. Further, since the photo-curable resin is used as the adhesive 150, it is possible to quickly perform the fixing after the positioning (positional adjustment), improving the positioning precision and the production efficiency.

According to the method for assembling the LED exposure device 100 explained in the embodiment, the first adhesive 151 is coated on the plurality of projections 114, which project from the casing 110 toward the plate member 120, and the first adhesive 151 is cured in a state that the positions of the reference holes 122, 123 are adjusted (subjected to the positional adjustment) with respect to the light-emitting sections. Then, the casing 110 and the plate member 120 are adhered to each other, at the portion of the casing 110 and the portion of the plate member 120 which face each other and which are different from the projections 114, with the second adhesive 152 having the elastic coefficient after curing which is smaller than that of the first adhesive 151. Therefore, it is possible to fix the position of the plate member 120 with respect to the casing 110 with the first adhesive 151. Thereafter, even when the second adhesive 152 is shrank when the second adhesive 152 is cured, the force generated to the shrinkage of the second adhesive 152 and compromising or changing the positional relationship between the casing 110 and the plate member 120, is small as compared with the fixing force by the first adhesive 151. Therefore, the positional relationship between the casing 110 and the plate member 120 fixed by the first adhesive 151 is not compromised or changed.

As described above, the first embodiment of the present invention has been explained. However, the present invention is not limited to the above-described embodiment. With respect to the specific construction or arrangement, it is possible to appropriately make changes within the gist and spirit of the present invention. For example, in the first embodiment, the positional relationship in the longitudinal direction of the casing 110 and the plate member 120 is determined by bringing the casing 110 into contact with the side wall 202 of the positioning jig 100 and by supporting the plate member 120 with the support tools 207. However, it is allowable to adjust the position in the longitudinal direction of the casing 110 with respect to the plate member 120 in a similar manner as that regarding the width direction, namely by using the positional measurement result by the CCD 204 and by moving the position in the longitudinal direction of the casing 110 with respect to the plate member 120 manually or by feedback control.

Further, the LED array 132 has a manufacturing warpage in some cases in which a row of the light-emitting sections are arched or embowed as seen from the optical axis direction. In such a case, however, it is also possible to cure the adhesive 150 in a state that such warpage is rectified by applying force to the casing 110.

In the first embodiment, although the projections 114 are provided on the casing 110, the projections 114 may be provided on the plate member 120. Further, the first adhesive 151 may be coated on the plate member 120 at portions corresponding to the projections 114, instead of being coated on the projections 114. Further, although the reference holes 122, 123 are used as examples of the reference portion, the shape of the reference portion is not specifically limited provided that the positional adjustment (positioning) can be performed with respect other part or component.

Moreover, although the plate member 120 is used as an example of the frame member, it is not necessarily indispensable that the frame member has a plate-shape. For example, it is allowable to use those having a cup-shape, a cylindrical-bar shape, a rod (bar)-shaped member having a different cross-sectional shape, etc.

Second Embodiment

In the following, a detailed explanation will be given about a second embodiment of the present invention, while appropriately referring to the drawings. Note that in the following explanation, the overall construction of the color printer is same or similar to that of the image forming apparatus provided with the exposure device according to the first embodiment, same reference numerals are assigned to parts or components same as those of the first embodiment, and any explanation therefor will be omitted. The characteristic part(s) of the second embodiment of the present invention will be explained in detail as below.

Construction of the LED Unit

A detailed explanation will be given about an LED unit 340 as the characteristic part of the present invention.

Figure 8:
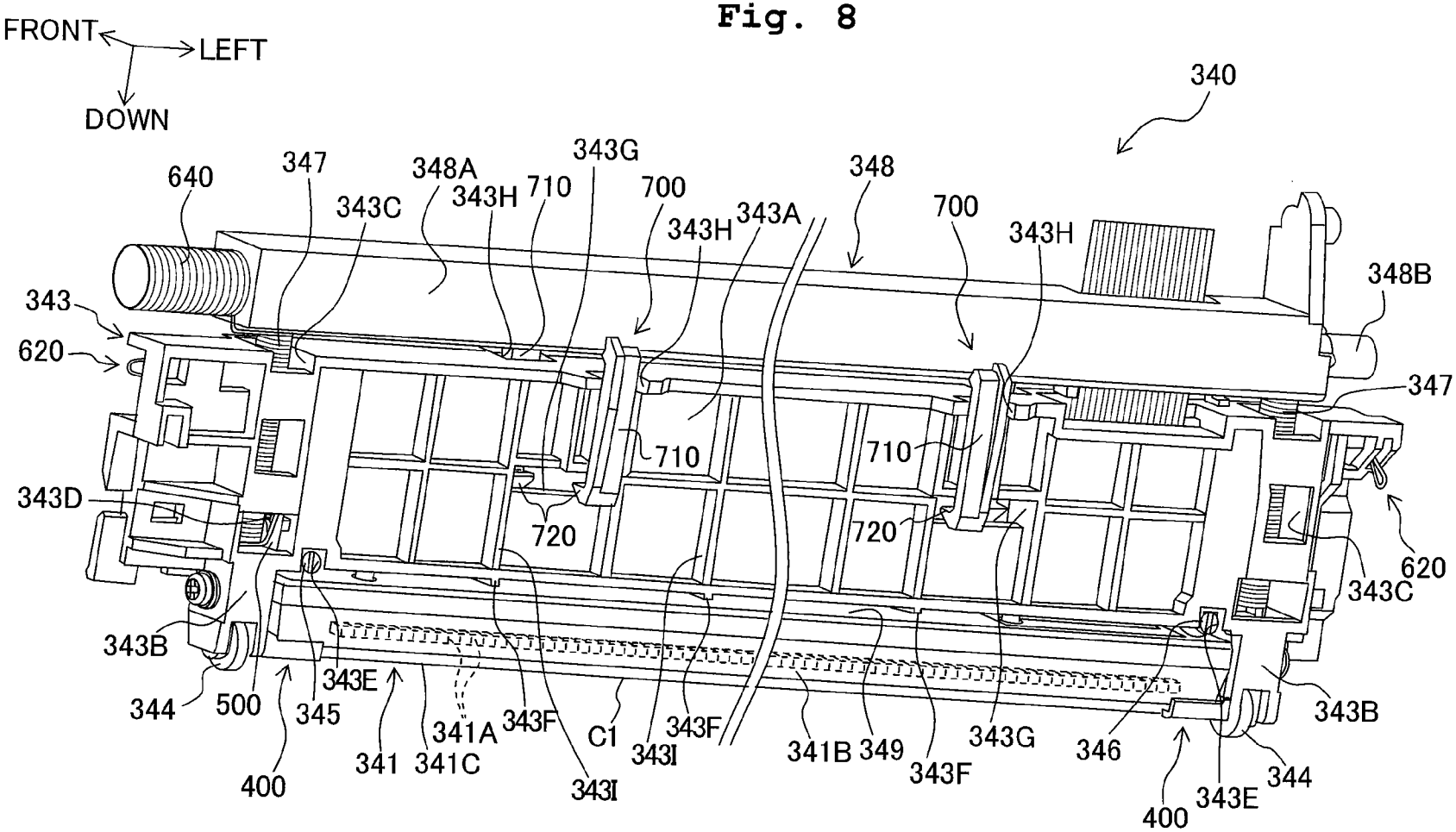
FIG. 8 is a perspective view of an LED unit as seen from the rear side thereof.
Figure 9:
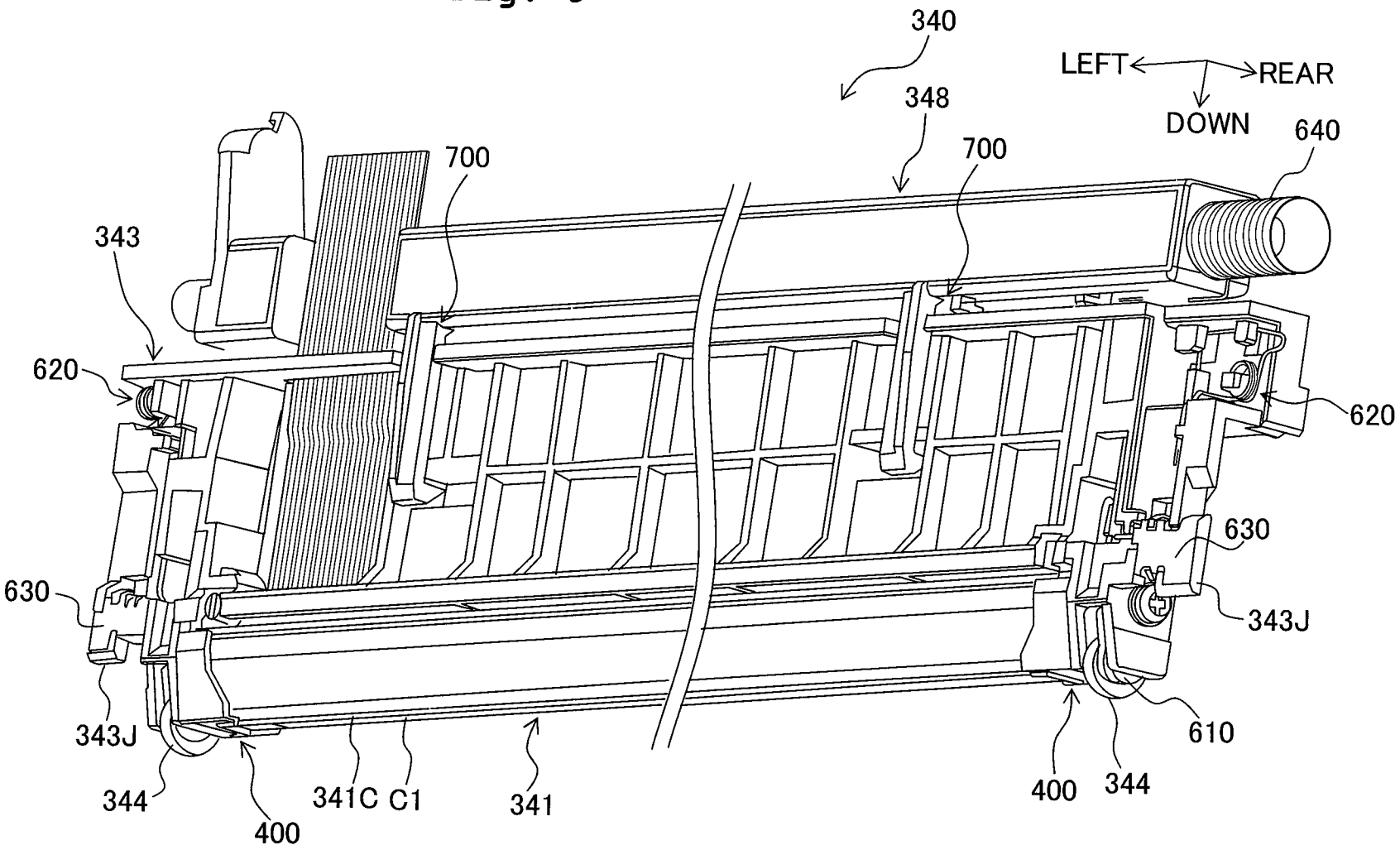
FIG. 9 is a perspective view of the LED unit as seen from the front side thereof.

As shown in FIGS. 8 and 9, the LED unit 340 mainly includes an elongated LED head 341 as an example of the exposure member; a support frame 343 made of resin; two guide rollers 344 as an example of the distance-maintaining member; two eccentric cams 345, 346 as an example of the adjusting member; and a holder 348.

LED Head 341

The LED head 341 includes a plurality of LED arrays 341A formed of a large number of LEDs arranged on a semiconductor chip; a head frame 341B as an example of housing; and a lens array 341C. In the embodiment, the blinking section (intermittent light-emitting sections) is constructed, as an example, of the plurality of LED arrays 341A and the lens array 341C.

The LED arrays 341A are aligned in a row in accordance with a predetermined pixel pitch in the left and right direction (axis direction of the photoconductive drum 53), and when the LED arrays 341A are driven selectively, the LED arrays 341A emit light appropriately and intermittently toward the photoconductive drum 53. Specifically, a signal is inputted, based on data of an image to be formed, from an unillustrated controller to each of the LED arrays 341A, thereby causing the LED arrays 341A to emit the light to expose the photoconductive drum 53.

The head frame 341B is formed of resin and supports the LED arrays 341A and the lens array 341C. Note that since the head frame 341B is made of resin, it is possible to realize a compact sized LED head 341 with a low cost and to suppress electric discharge from a high-voltage part such as the electrostatic charger.

On the upper surface of the head frame 341B, a sheet metal 349 is arranged to extend in the longitudinal direction of the head frame 341B. With this, the LED head 341 is reinforced by the sheet metal 349.

The lens array 341C causes the light emitted from each of the LED arrays 341A to focus on the photoconductive drum 53, and is constructed by aligning, in a row, GRIN lenses (cylindrical shaped lenses) made of glass as an example of gradient index lens which has a light-exit surface formed in a planar shape.

The lens array 341C is formed to have an elongated shape extending in the axis direction of the photoconductive drum 53, and is fixed to the head frame 341B in a state that the lens array 341C protrudes downward from the lower surface of the head frame 341B, except that the lens array 341C is not provided on small portions in the both end sides of the head frame 341B. Two resin covers 400, which are softer than the lens array 341C, are arranged at the both end portions of the lens array 341C, respectively.

In some cases, after the lens array 341C is formed to have the elongated form, the lens array 341C is cut in the longitudinal direction thereof into a length required. In such a case, a pointed portion (sharp portion) is formed in a portion (cut portion) of the lens array 341C at which the lens array 341C is cut, and the pointed portion can become a factor that the cloth, etc. is caught or hooked by the pointed portion during the cleaning. In consideration of this, the corner portion of the cover 400 made of resin is formed to have a shape which is rounder than the corner portion of the lens array 341 made of glass because when the cover 400 is formed by injection molding, the shape of the die (mould) having a rounded corner portion is transferred to the corner portion of the cover 400. With this, the possibility, that the cloth, etc. is caught or hooked by the cover 400 made of resin, is quite low. In the following, the cover 400 will be explained in detail.

Cover 400

Figure 10:
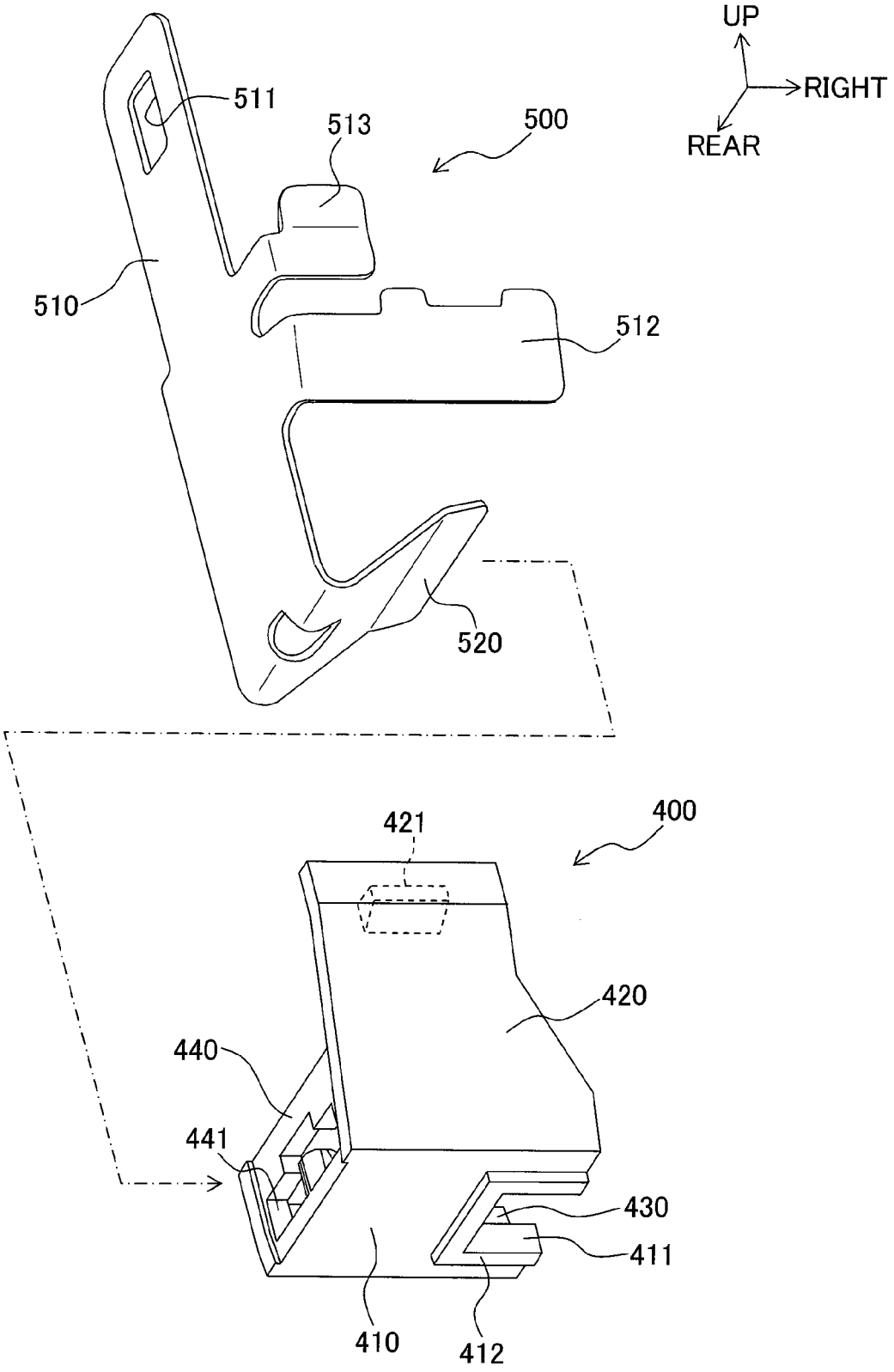
FIG. 10 is a perspective view showing a cover and a leaf spring.

As shown in FIG. 10, the cover 400 includes a lower wall portion 410, a front wall portion 420, a rear wall portion 430 and a side wall portion 440.

The lower wall portion 410 is arranged to face or to be opposite to the lower surface of the head frame 341B included in the LED head 341. A "U"-shaped cutout 411 is formed on an edge portion, of the lower wall portion 410, on the inner side in the left and right direction and along the end portion of the lens array 341C. Further, a protection wall 412 is formed around the cutout 411 to project downward and surround the end portion (corner portion) of the lens array 341C.

The protection wall 412 is formed to have a height such that the lower end (tip end portion) of the protection wall 412 is projected downward to a position below the lower surface (light-exit surface) of the lens array 341C. Note that it is enough that the height of the protection wall 412 is flush with or higher than the light-exit surface of the lens array 341C, and it is also allowable that the lower end of the protection wall 412 is flush with the light-exit surface of the lens array 341C. Here, the term "height to be flush with or higher than" means that the protection wall 412 has a height such that the end portion of the protection wall 412 is located at a position same as that of the light-exit surface of the lens array 341C or to be projected to the position below the light-exit surface.

The front wall portion 420 is formed to have a height substantially same as the height in the up and down direction of the LED head 341. Further, an engagement projection 421, which is engaged with an engagement arm portion 512 of a leaf spring 500 (to be explained later on), is formed in the front wall portion 420 at an upper portion in the back surface of the front wall portion 420.

The rear wall portion 430 is formed to have a height lower than that of the front wall portion 420, and is arranged to be opposite (to face) the LED head 341 at a lower portion in the back surface of the LED head 341.

The side wall portion 440 is formed to have a height substantially same as that of the rear wall portion 430, and is arranged to face the left or right side wall of the LED head 341. An insertion hole 441 is formed on the side wall portion 440 at the lower portion thereof. The insertion hole 441 is formed to have a rectangular shape into which a lower wall portion 520 of the leaf spring 500 is inserted, as will be explained later on.

Leaf Spring 500

The leaf spring 500 mainly includes a side wall portion 510 and a lower wall portion 520 and is bent in a "V"-shaped form.

The side wall portion 510 is formed to have a length greater than the height in the up and down direction of the LED head 341. An insertion hole 511, which has a substantially rectangular form and which is engaged with an engagement projection 343D (to be described later; see FIG. 8) of the support frame 343, is formed in the side wall portion 510 at an upper portion of the side wall portion 510.

Further, an engagement arm portion 512, which is engaged with the engagement projection 421 of the cover 400 from below, and a grounding arm portion 513 which is arranged above or over the engagement arm portion 512 and which is brought into contact with the sheet metal 349 of the LED head 341 (see FIG. 13) are formed on an front end portion of the side wall portion 510.

The lower wall portion 520 of the leaf spring 500 is inserted to the insertion hole 441 of the cover 400 and the engagement projection 421 of the cover 400 is inserted between the engagement arm portion 512 and the grounding arm portion 513 of the leaf spring 500, thereby attaching the cover 400 to the leaf spring 500. Further, in this state, by making the engagement hole 511 formed in the upper end of the leaf spring 500 be hooked to the engagement projection 343D (to be described later; see FIG. 8) of the support frame 343, the LED head 341 is biased to be pulled toward the support frame 343, at the lower wall portion 520 of the leaf spring 500.

With this, the LED head 341 is supported by the support frame 343 via the leaf spring 500. In this state, the cover 400 is pressed upward at the side wall portion 440 and the engagement projection 421 thereof by the lower wall portion 520 and the engagement arm portion 512 of the leaf spring 500, so that the engagement projection 421 is pressed against the LED head 341, thereby fixing the cover 400 to the LED head 341.

Namely, the LED head 341 and the cover 400 (engagement projection 421) are held by the leaf spring 500 and the support frame 343. Note that the cover 400 is constructed such that a small clearance (gap) is provided between the cover 400 and the LED head 341, at a portion different from the engagement projection 421, so as to prevent the cover 400 from contacting with the LED head 341 except at the engagement projection 421.

Support Frame 343

As shown in FIGS. 8 and 9, the support frame 343 includes a base portion 343A elongated in the left and right direction, and a pair of extending portions 343B extending downward from both ends of the base portion 343A, respectively.

Coil-spring accommodating portions 343C are formed on the upper surface of the base portion 343A at the left and right side portions, respectively. Each of the coil-spring accommodating portions 343C is a downward recess having a bottomed cylindrical shape. A coil spring 347, as an example of the pressing member which presses the support frame 343 toward or against the photoconductive drum 53 located below the support frame 343, is arranged inside each of the coil-spring accommodating portions 343C. Further, a hole (of which reference numeral is omitted) is formed in the bottom surface (bottom wall) of the coil-spring accommodating portion 343C, and the upper end portion of the leaf spring 500 is insertable (inserted) to this hole from below.

Furthermore, the engagement projection 343D, which is engaged with the rectangular engagement hole 511 (see FIG. 10) formed in the upper end of the leaf spring 500, is formed in the inner circumference surface of the coil-spring accommodating portion 343C. Moreover, two bearing portions 343E, which rotatably support the eccentric cams 345, 346 respectively, are formed in the base portion 343A on the lower surface on the left and right side portions thereof, respectively.

A plurality of projection portions 343F which project toward the LED head 341 are formed on the lower surface of the base portion 343A. The respective projection portions 343F are arranged between the pair of eccentric cams 345 and 346, and are arranged in the longitudinal direction of the LED head 341 at a predetermined spacing distance. Further, the base portion 343A has ribs 3431, and the projection portions 343F are formed in a virtual line extended in the optical axis direction of the ribs 3431, respectively.

Here, each of the projection portions 343F is constructed so as not to come into contact with the LED head 341 when each of the eccentric cams 345 and 346 is in a phase in which the LED head 341 and the base portion 343A are closest to each other. In other words, each of the projection portions 343F is formed such that, when the LED head 341 which is moved upward and downward by the rotation of the eccentric cams 345 and 346 approaches closest to the support frame 343, the projection portion 343F is located to be higher than (above) the upper surface of the LED head 341.

Holes 343G are formed in the base portion 343A at portions on the inner side (inner-side portions) in the left and right direction with respect to the coil-accommodating portions 343C, respectively. The holes 343G are formed penetrating, in the front and rear direction, the inner-side portions of the base portion 343A on the left and right sides, respectively; and pawls 720 of a pair of hooks 700 (to be described later) are engaged with the holes 343G. Further, a plurality of recessed portions 343H each of which can accommodate a portion of an arm 710 of each of the hooks 700 (to be described later) are formed in the support frame 343 at portions above the holes 343G, corresponding to the arms 710, respectively.

Figure 11:
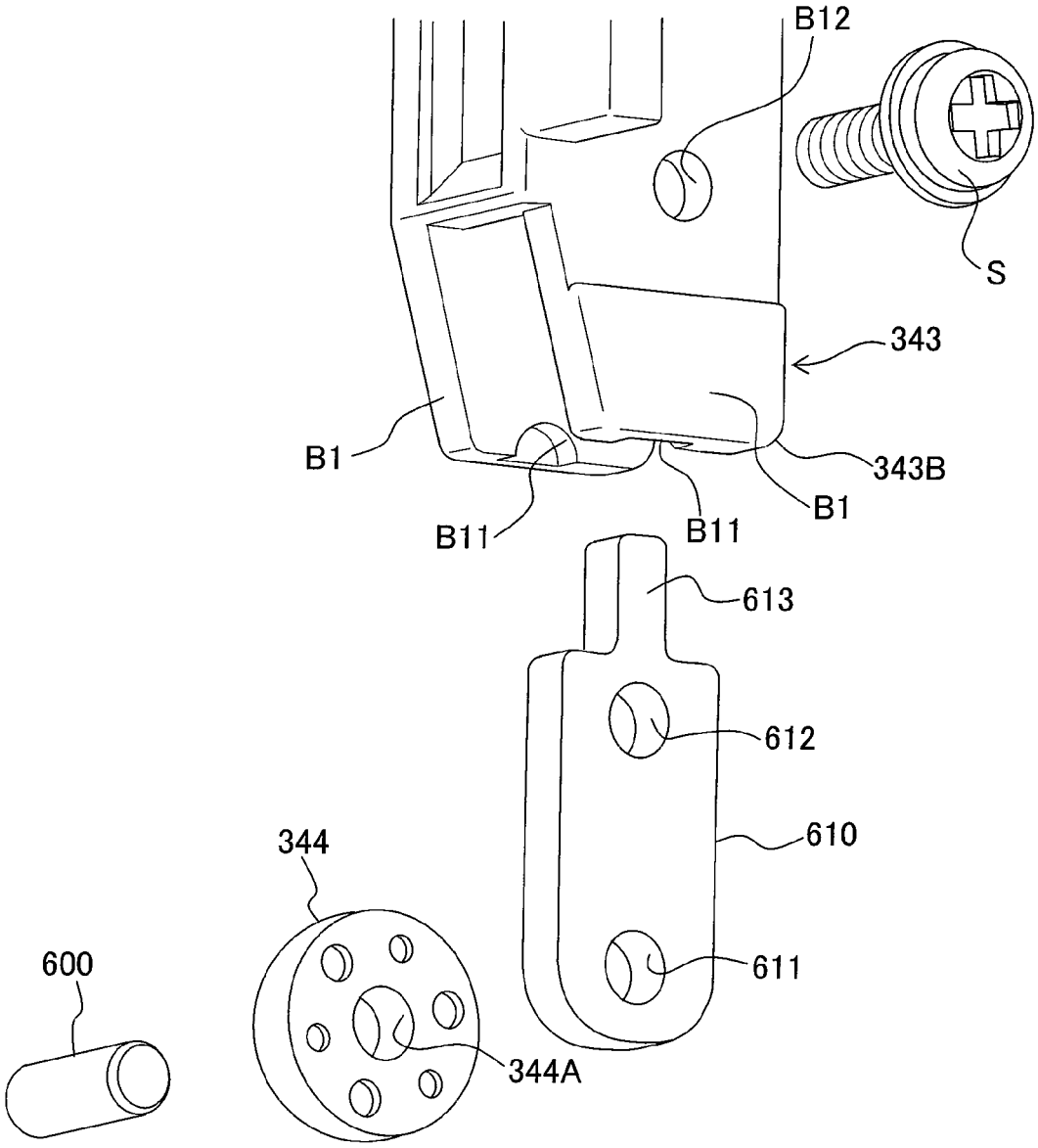
FIG. 11 is an exploded perspective view of the construction around a guide roller.

Each of the extending portions 343B is provided with a guide roller 344 at the lower end portion of the extending portion 343B. Specifically, as shown in FIG. 11, the extending portion 343B has a pair of two-pronged (bifurcate) side wall portions B1 formed in the lower portion of the extending portion 343B; and a positioning portion B11 which is a recess (groove) having a substantially semicircular shape is formed in each of the side wall portions B1 on the inner wall surface at the lower end portion thereof. Further, an insertion hole B12 into which a screw S is insertable is formed in one side wall portion B1, of the pair of side wall portions B1, on the outer side in the left and right direction, at an upper portion of the one side wall portion B1.

Guide Roller 344

The guide roller 344 is a disc-shaped member made of resin and has a through hole 344A which is formed in the central portion of the guide roller 344 and through which a metallic roller shaft 600 is insertable. The roller shaft 600 is positioned with respect to the support frame 343 by being pressed, with a metal plate 610, against the positioning portions B11 of the support frame 343; and the roller shaft 600 is fixed unrotatably to the support frame 343 by the friction forces between the roller shaft 600 and the positioning portions B11 and between the roller shaft 600 and the metal plate 610.

The metal plate 610 is constructed to include an insertion hole 611 into which the roller shaft 600 is inserted, a screw hole 612 formed above the insertion hole 611, and a grounding projection 613 extending upward from the upper end of the metal plate 610. The tip portion (end portion) of the grounding projection 613 is passed through an unillustrated hole formed in the bottom wall of the coil-spring accommodating portion 343C (see FIG. 8) and then is arranged inside the coil-spring accommodating portion 343C.

Upon attaching the guide roller 344 to the support frame 343, at first, the roller shaft 600 is inserted through the through hole 344A of the guide roller 344 and the insertion hole 611 of the metal plate 610, and then the guide roller 344 and the metal plate 610 are inserted between the pair of side wall portions B1 of the support frame 344, and the roller shaft 600 is made to abut against the positioning portions B11.

Afterwards, the metal plate 610 is inserted further into the support frame 343 such that the roller shaft 600 is strongly pressed against the positioning portions B11. In this state, the screw S is passed through the insertion hole B12 formed in the side wall portion B1 to screw the screw S to the screw hole 612 of the metal plate 610, thereby unrotatably fixing the roller shaft 600 with respect to the support frame 343 in a state that the roller shaft 600 is strongly pressed against the support frame 343. With this, the guide roller 344 is rotatably supported to the roller shaft 600 which is unrotatable with respect to the support frame 343.

The biasing force from the coil spring 347 is transmitted via the support frame 343 to the guide roller 344 supported in such a manner, to thereby press the guide roller 344 against the photoconductive drum 53 so that the guide roller 344 is driven following the driving of the photoconductive drum 53. With this, even in a case that the photoconductive drum 53 is eccentric, the spacing distance (clearance) in the optical axis direction between the photoconductive drum 53 and the LED head 341 supported by the support frame 343 is maintained by the guide roller 344.

The metal plate 610, which fixes the roller shaft 600 to the support frame 343 as described above, is electrically grounded. In the following, an explanation will be given about this grounding structure with reference to FIGS. 12 and 13.

Grounding Structure for Grounding the Metal Plate 610

Figure 12:
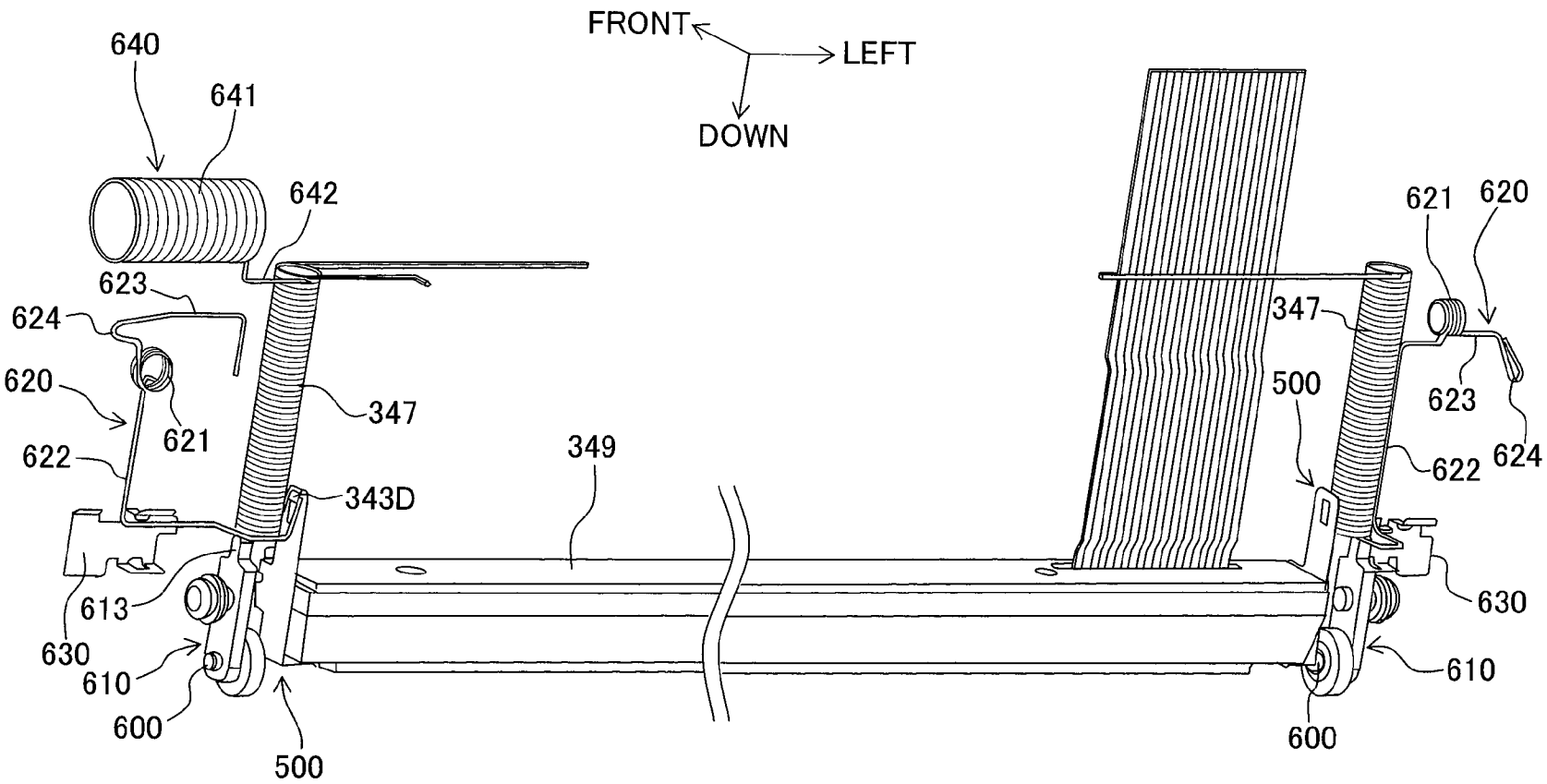
FIG. 12 is a perspective view of metal parts, as seen from the rear side thereof, provided for grounding a metal plate.
Figure 13:
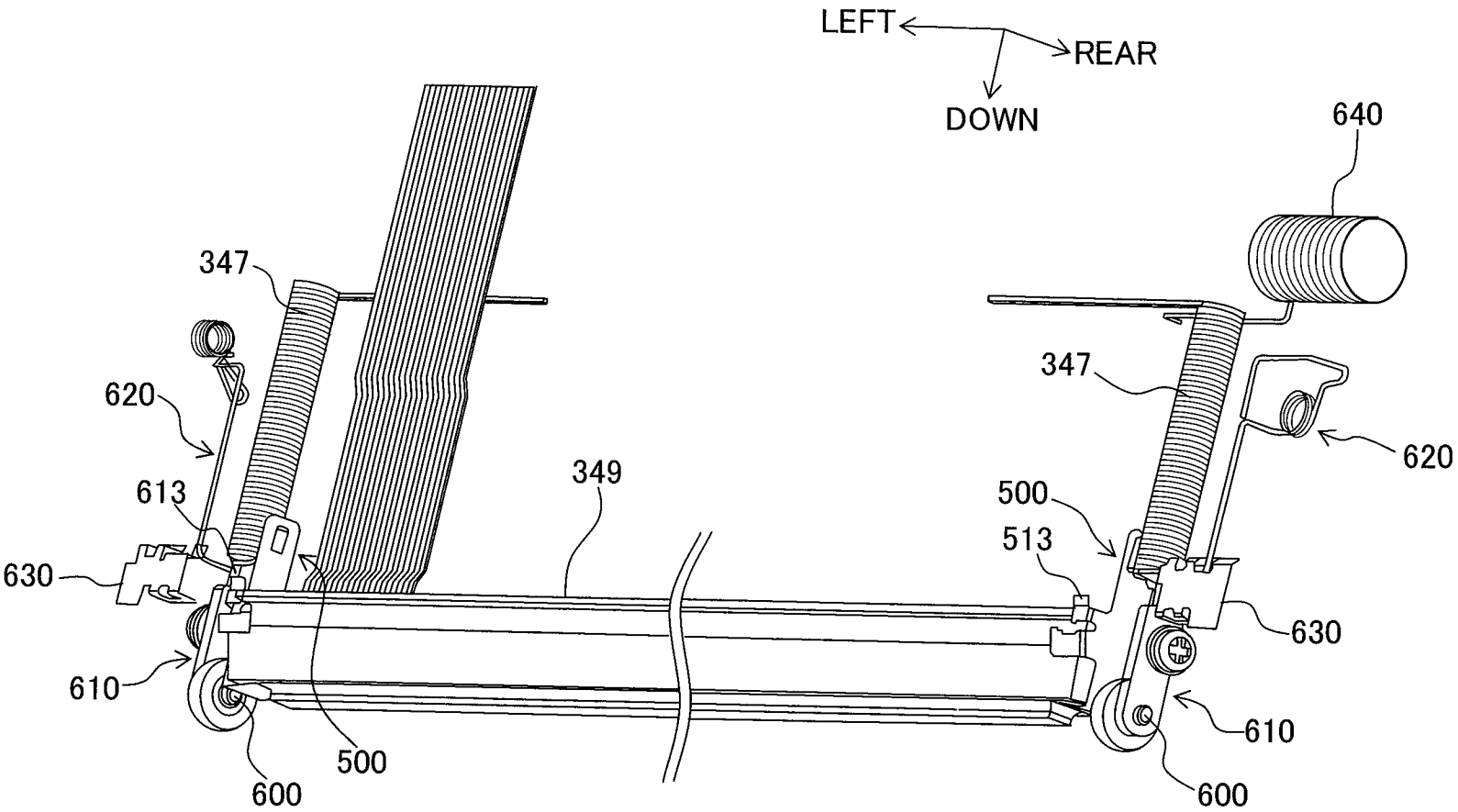
FIG. 13 is a perspective view of the metal parts, as seen from the front side thereof, provided for grounding the metal plate.

As shown in FIGS. 12 and 13, the metal plate 610 is electrically grounded via a wire spring 620, a grounding plate 630, the coil spring 347, a holder-side coil spring 640, the leaf spring 500 and the sheet metal 349 which are provided on the LED unit 340 and via an unillustrated metal frame provided on the body housing 10 or the upper cover 12.

The wire spring 620 is fixed to the support frame 343 (see FIGS. 8 and 9), and is constructed to mainly include a coil-spring portion 621, a pressing arm portion 622 and a contact-arm portion 623. The pressing arm portion 622 is formed to have a substantially "L"-shape extending downward from the coil-spring portion 621 and then directing toward the inner side in the left and right direction of the support frame 343. The pressing arm portion 622 presses, at the tip portion thereof, the upper end portion of the leaf spring 500 against the inner circumference surface of the coil-spring accommodating portion 343C.

With this, the engagement hole 511 of the leaf spring 500 is firmly engaged with the engagement projection 343D of the coil-spring accommodating portion 343C (see FIG. 8) and the wire spring 620 is electrically connected, via the leaf spring 500 and the sheet metal 349, to the other leaf spring 500 which is arranged on the left side of the support frame 343 (LED head 341). Further, the pressing arm portion 622 is brought into contact with the grounding projection 613 of the metal plate 610 and the grounding plate 630.

The contact-arm portion 623 has a contact point 624 which is formed to be turned or folded back in a substantially "U"-shaped form. The contact point 624 is rockably movable with the coil-spring portion 621 as the rocking center. The contact point 624 is satisfactorily grounded since the contact point 624 is biased against the metal plate of the body housing 10.

As shown in FIG. 9, the grounding plate 630 is fixed to a plate-shaped piece 343J for positioning which is formed in the support frame 343 at each of the outer side portions of the support frame 343 in the left and right direction. The plate-shaped piece 343J is held between an unillustrated pressing arm and an unillustrated positioning member arranged in the body housing 10. Further, in a state that the plate-shaped piece 343J is positioned by being pressed against the positioning member with the pressing arm, the grounding plate 630 is brought into contact with a metal part which is provided on the pressing arm, and thus the grounding plate 630 is electrically grounded via this metal part.

As shown in FIGS. 12 and 13, each of the coil springs 347 is in contact with the grounding projection 613 of the metal plate 610, at the lower end portion of the coil spring 347. Further, the upper end portion of the coil spring 347, which is arranged on the right side, is in contact with the holder-side coil spring 640.

The holder-side coil spring 640 is provided on the holder 348 only at the right side portion of the holder 348, and has a coil-spring portion 641 and a spring-leg portion 642. The spring-leg portion 642 of the holder-side coil spring 640 makes contact with the coil spring 347, and the outer end portion of the coil-spring portion 641 in the left and right direction makes contact with a metal plate provided on the upper cover 12. Note that the metal plate of the upper cover 12 makes contact with the metal plate of the body housing 10.

As described above, the metal plate 610 on the right side is electrically grounded mainly via: a first route from the wire spring 620 and arriving, via the grounding plate 630, at the metal part of the pressing arm of the body housing 10; a second route from the wire spring 620 and arriving at the metal plate of the body housing 10; and a third route from the coil spring 347 and arriving, via the holder-side coil spring 640, at the metal plates of the upper cover 12 and the body housing 10. On the other hand, the metal plate 610 on the left side is electrically grounded mainly via the above-described first and second routes because the holder-side coil spring 640 is not provided on the left side.

Further, the metal plate 610 on the right side is grounded also via the first and second routes for the metal plate 610 on the left side, because the right-side metal plate 610 is electrically connected to the left-side metal plate 610 via the wire spring 620 on the right side, the leaf spring 500 on the right side, the sheet metal 349, the leaf spring 500 on the left side and the wire spring 620 on the left side. In a similar manner, the left-side metal plate 610 is grounded also via the first to third routes for the right-side metal plate 610. Therefore, the metal plates 610 on the left and right sides are electrically grounded via five routes.

Eccentric Cams 345, 346

As shown in FIGS. 8 and 9, the eccentric cams 345 and 346 adjust the spacing distance between the LED head 341 and the support frame 343, and are arranged, to be away from each other in the left and right direction, between the LED head 341 and the base portion 343A of the support frame 343. Each of the eccentric cams 345 and 346 presses the LED head 341 in the optical axis direction while being biased by the biasing force from the leaf spring 500.

The eccentric cam 346 located on the left side among the pair of eccentric cams 345, 346 is constructed to press the LED head 341 at one position; and the eccentric cam 345 located on the right side among the pair of eccentric cams 345, 346 is constructed to press the LED head 341 at two positions. Namely, the LED head 341 makes contact with all the eccentric cams 345, 346 only at three positions.

Holder 348

The holder 348 is made of resin, and mainly includes a base portion 348A which has an elongated shape extending in the left and right direction, and the hook 700 which is hooked to the support frame 343 to thereby support the support frame 343 movably upward and downward relative to the holder 348.

Pivot shaft portions 348B are provided on the base portion 348A, at both end surfaces of the base portion 348A, extending outward in the left and right directions respectively. The pivot shaft portions 348B are supported pivotably to the LED-attachment member 14 of the upper cover 12 to thereby make the holder 348 pivotable with respect to the upper cover 12. Further, the above-described holder-side coil spring 640 is attached to a pivot shaft portion 348B (not illustrated in the drawings), among the pivot shaft portions 348B, which is located on the right side.

The coil spring 347 is arranged between the base portion 348A and the support frame 343 (each of the coil-spring accommodating sections 343C), thereby pressing the support frame 343 in a direction away from the holder 348.

Two pieces (a plurality of pieces) of the hook 700 are provided on the holder 348 in the left and right direction (longitudinal direction of the LED head 341) at a predetermined spacing distance. Each of the hooks 700 is constructed to include a pair of arms 710 and a pair of pawls 720 each formed to be bent from an end portion of one of the arms 710 toward the support frame 343.

The arms 710 are each constructed to be elastically deformable, and are arranged in the support frame 343 on the both sides in the width direction of the support frame 343. Here, the term "width direction" means a direction orthogonal to the longitudinal direction of the LED head 341 and the optical axis direction of the light emitted from the LED head 341.

Further, in each of the pairs of arms 710, the arms 710 are arranged to be shifted in the left and right direction. More specifically, a pair of arms 710, among the pairs of arms 710, which constructs one hook 700 among the two hooks 700, is arranged such that the arms 710 are shifted in a direction different from another direction in which arms 710 belonging to the other hook 700 are shifted.

Namely, in the hook 700 on the right side, the arm 710 on the rear side is shifted leftward with respect to the arm 710 pairing with the rear-side arm 710 and arranged on the front side, while in the hook 700 on the left side, the arm 710 on the rear side is shifted rightward with respect to the arm 710 pairing with the rear-side arm 710 and arranged on the front side. With this, upon attaching the holder 348 to the support frame 343 in a state that the holder 348 is turned over from the posture (orientation) illustrated in the drawing, the arms 710 cannot fit with the recessed portions 343H of the support frame 343, respectively, thereby preventing any misassemble or incorrect assemble.

The pawls 720 are engaged with the holes 343G of the support frame 343 from below. In a state that the pawls 720 are engaged with the holes 343G, gap (clearance) is defined between the pair of arms 710 and the support frame 343. This makes it possible that the support frame 343 is movable frontward and rearward in a state that the support frame 343 is supported by the hooks 700.

Since the holder 348 is constructed as described above, it is possible that when the upper cover 12 is closed, the support frame 343 movable with respect to the holder 348 can be easily positioned with an unillustrated positioning member. Further, in a case, for example, that the rotational axis of the photoconductive drum 53 is eccentric with respect to the body of the photoconductive drum 53, due to manufacturing error, etc., and even if the LED head 341 and the support frame 343 are reciprocated upward and downward following the surface of the photoconductive drum 53 rotating in eccentric manner, it is possible to absorb the up and down reciprocation in the gap between the holder 348 and the support frame 343. Furthermore, when the upper cover 12 is opened, the biasing force of the coil spring 347 is applied only to the support frame 343, but not applied to the LED head 341.

Note that it is preferable that the holder 348 is formed to have such rigidity that the holder 348 is deformable more easily than the support frame 343. With this, even in a case, for example, that a strong force in the upward direction is applied to the support frame 343 and thus the biasing force of the coil spring 347 becomes excessively strong, the holder 348 is first deformed rather than the support frame 343, thereby making it possible to maintain the shape of the support frame 343 engaged with the positioning member of the body housing 10 and thus to maintain the correct positioning.

Since the covers 400, which are made of resin and which extends (projects) downward to a position below the light-exit surface of the lens array 341C, are provided on the both end portions of the lens array 341C, it is possible to easily perform cleaning operation for the lens array 341C and to suppress the breakage of any cloth (cleaning cloth), etc., thereby making it possible to maintain the image quality satisfactorily.

Since the lens array 341C is constructed of a plurality of GRIN lens having the flat light-exit surfaces, it is possible to easily clean the flat light-exit surfaces with a cloth, etc.

Since the LED head 341 and the covers 400 are held by the leaf spring 500 and the support frame 343, it is possible to construct a part for fixing the LED head 341 to the support frame 343 and a part for fixing the cover 400 to the LED head 341 as one leaf spring 500, thereby making it possible to reduce the number of parts. Further, since the cover 400 is pressed against and fixed to the LED head 341 with the leaf spring 500, there is no need to form a recess, etc. in the LED head 341 for the purpose of hooking the cover 400 and attaching the cover 400 to the LED head 341, thus making it possible to enhance the rigidity of the LED head 341.

The projection portions 343F projecting toward the LED head 341 are formed on the support frame 343. Therefore, even when a force is applied to the LED head 341 from below to cause the LED head 341 warp with the eccentric cams 345, 346 as the warpage points, such warpage of the LED head 341 can be suppressed by the projection portions 343F. With this, it is possible to suppress the deformation of the LED head 341 and to thus improve the image quality.

Note that it is also possible to suppress the deformation of the LED head 341 by lowering, as a whole, the lower surface of the base portion 343A of the support frame 343. However, the precise control can be performed more easily and precisely with the small-sized projection portions 343F as in the embodiment, than lowering the entire lower surface of the base portion 343A.

A plurality of pieces of the projection portion 343F is arranged on the support frame 343 in the longitudinal direction of the LED head 341 at a predetermined spacing distance. Accordingly, even if a power is applied to the LED head 341 at any positions in the longitudinal direction of the LED head 341, it is possible to suppress the warpage of the LED head 341 at each of such positions in an assured manner.

Each of the projection portions 343F is formed to have a height such that, when the eccentric cams 345 and 346 are in the phase in which the LED head 341 approaches closest to the base portion 343A, each of the projection portions 343F does not make contact with the LED head 341. Accordingly, it is possible to secure large adjusting margin for the eccentric cams 345 and 346.

Since the LED head 341 is reinforced with the metal sheet 349 extending in the longitudinal direction of the LED head 341, it is possible to suppress the warpage of the LED head 341 securely.

By supporting the support frame 343, which supports the LED unit 341, with the holder 348 such that the support frame 343 is movable relative to the holder 348 and by proving the coil springs 347 between the support frame 343 and the holder 348, it is possible to prevent the biasing force of the coil springs 347 from applying to the LED head 341 when the upper cover 12 is opened, thereby suppressing the deformation of the LED head 341.

Since the plurality of hooks 700 are provided on the holder 348 with a predetermined spacing distance in the longitudinal direction of the LED head 341, it is possible to stably support the support frame 343 having elongated shape with the plurality of hooks 700.

Since the gap is provided between each of the arms 710 of the hook 700 and the support frame 343 to thereby make the support frame 343 movable frontward and rearward with respect to the holder 348, it is possible to easily position the LED head 341 in the front and rear direction.

Since the arms 710 of each of the pair of hooks 700 are shifted in the longitudinal direction of the LED head 341, it is possible to easily produce the holder 348 with a resin by the injection molding using a die of which pull-out direction (draft direction) is the front and rear direction of the holder 348. Further, since the arms 710 are shifted in the longitudinal direction, it is possible to form the pawls 720 to be long, thereby supporting the support frame 343 assuredly with the pawls 720 of the hooks 700.

Since the shift direction in which the arms 710 on the right side are shifted from each other is different from a shift direction in which the arms 710 on the left side are shifted from each other, and since the recessed portions 343H which can accommodate the arms 710 respectively are formed in the support frame 343, it is possible to prevent mis-assembly of the holder 348 and the support frame 343.

The holder 348 is made pivotable with respect to the upper cover 12. Accordingly, when the upper cover 12 is opened upwardly, the end portion of the LED unit 340 is always oriented or directed downward due to the gravity, and thus it is possible to prevent the end portion of the LED unit 340 from jutting toward the user when the upper cover 12 is opened. Further, only the connecting section between the upper cover 12 and the holder 348 is allowed to be pivotable. Therefore, it is possible to suppress any unnecessary movement of the LED head 341 with respect to the upper cover 12 and thus to position the LED head 341 correctly, than in a case, for example, in which the connecting section between the upper cover and the holder is constructed of an elongated hole and a columnar-shaped projection to be pivotable as well as movable in the optical axis direction.

Since the roller shaft 600 is grounded via the metal plate 610, etc., it is possible to solve a problem such as false operation or malfunction of the LED head 341 which is otherwise caused when the roll shaft 600 is electrically floated. Further, since the metal plate 610 which fixes the roller shaft 600 to the support frame 343 is used for the grounding purpose as well, there is no need to provide any additional part for the grounding purpose. Therefore, it is possible to suitably arrange the parts or components around the roller shaft 600 and to decrease the number of the parts.

Since the positioning portions B11 for positioning the roller shaft 600 are formed in the support frame 343, it is possible to precisely position the roller shaft 600 with respect to the support frame 343.

Since the positioning portions B11 are formed in recess-shape, it is possible to form a positioning plane more precisely than in a case that the positioning portions are formed in a hole-shape.

Figure 14:
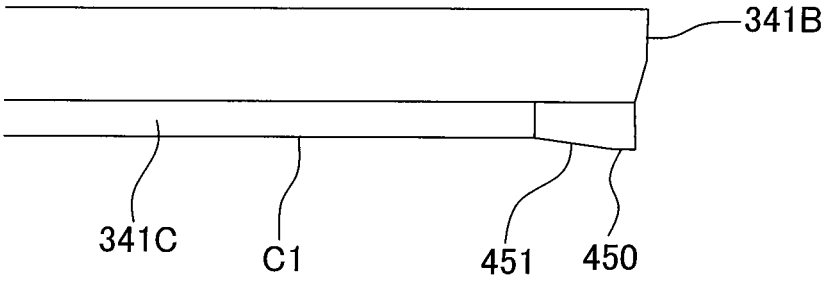
FIG. 14 is a view showing a modification of the cover.

Note that the present invention is not limited to the first and second embodiments as described above, and is applicable in various forms as exemplified below. The shape of the cover is not limited as that in the second embodiment, and it is allowable to adopt various shapes. For example, as shown in FIG. 14, it is allowable to provide, on a cover 450, an inclined surface 451 which is formed in the cover 450 to be inclined, from an end portion on the side of a head frame 341B, such that the inclined surface 451 is inclined upwardly (toward the light-exit surface of the lens array 341C) as approaching closely toward the lens array 341C and that the inclined surface 451 is continued (connected) to a lower surface C1 of the lens array 341C.

With this, upon performing cleaning, the cloth, etc. is guided to the end portion of the lens array 341C by the inclined surface 451, thereby making it possible to start the cleaning satisfactorily from the end portion of the lens array 341C. Further, any foreign matter, which is accumulated on the lens array 341C in advancing direction in which the cloth, etc. is moved sliding on the lens array 341C, is made to slide on the inclined surface 451 without being caught or stopped at a portion of difference in level (stepped portion) between the cover 450 and the lens array 341C. Accordingly, it is possible to satisfactorily remove the foreign matter on the lens array 341C.

Figure 15:
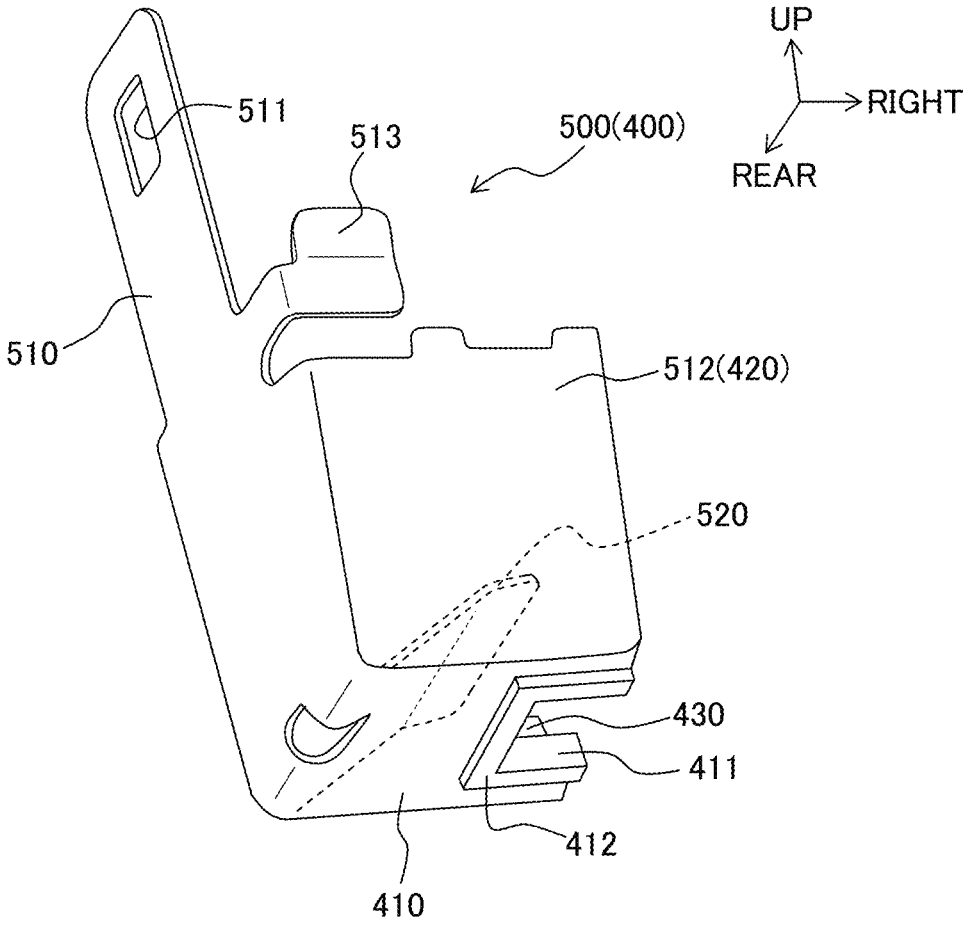
FIG. 15 is a perspective view showing a cover and a leaf spring according to another embodiment.

In the second embodiment, the cover 400 and the leaf spring 500 are constructed as separate parts. However, the present invention is not limited to this, and the cover and the elastic or resilient member may be constructed with a resin as an integrated part. This makes it possible to further reduce the number of parts. Note that as an example in which the cover and the resilient member are formed as an integrated part, it is possible to adopt a construction in which the cover 400 and the leaf spring 500 described above in the second embodiment are constructed with a resin as an integrated part as illustrated in FIG. 15, a construction in which the cover and a binding strap are constructed with a resin as an integrated part, etc.

In the second embodiment, the leaf spring 500 is adopted as the resilient member (elastic member). However, the present invention is not limited to this, and the resilient member may be a wire spring, etc.

In the second embodiment, the eccentric cams 345 and 346 are provided between the support frame 343 and the LED head 341. However, the present invention is not limited to this, and it is allowable that the LED head 341 is fixed directly to the support frame 343.

In the second embodiment, the rotatable guide roller 344 is adopted as the spacing distance-maintaining member. However, the present invention is not limited to this, and it is allowable to adopt a non-rotating member or part as the spacing distance-maintaining member.

In the first and second embodiments, the LED head 341 provided with the plurality of LED arrays 341A and the plurality of GRIN lenses which are aligned in a single row in the left and right direction is adopted as the exposure member. However, the present invention is not limited to this. For example, it is allowable to adopt, as the exposure member, a LED head having a plurality of LEDs, etc. which is aligned in a plurality of rows arranged in front and rear direction, each extending in the left and right direction. Alternatively, it is allowable to construct a plurality of blinking sections with one piece of light-emitting element such as an LED or a fluorescent light, and optical shutters formed of a plurality of liquid-crystal elements or PLZT elements which are aligned in the left and right direction and arranged at the outside of the light-emitting element; and to adopt an exposure element which is provided with such blinking sections as described above. Further alternatively, the light source of the exposure member is not limited to the LED, and may be an EL element (electro-luminescence element), a fluorescent substance or body, etc.

In the first and second embodiments, the photoconductive drum 53 is adopted as the photoconductive body. However, the present invention is not limited to this, and it is allowable to adopt, for example, a belt-shaped photoconductive body.

In the second embodiment, the eccentric cams 345 and 346 are adopted as the adjusting member. However, the present invention is not limited to this, and it is allowable to adopt a screw which advances/retreats in the axis direction, a cam other than the eccentric cam (for example, an egg-shaped cam), etc.

In the second embodiment, the projection portions 343F are provided on the support frame 343. However, the present invention is not limited to this, and it is allowable to provide the projection portions 343F on the LED head 341. In this case also, it is possible to suppress the warpage of the LED head 341.

Note that the projection portions 343F and the LED head 341 may be adhered to each other with an adhesive (in a case that the projection portions 343F are provided on the LED head 341, the projection portions 343F and the support frame 343 may be adhered to each other with adhesive). This makes it possible to stably support the LED head 341 with respect to the support frame 343.

In the first and second embodiments, the coil spring 47 is adopted as the pressing member. However, the present invention is not limited to this, and it is allowable to adopt a torsion spring, a leaf spring, etc.

In the first and second embodiments, the mis-assembly is prevented by making the pair of arms 710 at the right side be shifted from each other in a direction different from a direction in which the pair of arms 710 at the left side are shifted from each other. However, the present invention is not limited to this. It is allowable to prevent the mis-assembly by making the arms 710 at the right side be shifted from each other by a shift amount which is different from a shift amount by which the arms 710 at the left side are shifted from each other.

In the first and second embodiments, the upper cover 12 is adopted as the opening/closing cover. However, the present invention is not limited to this; and the opening/closing cover may be a front cover, for example.

In the second embodiment, the positioning portions B11 are formed as a semicircular recess. However, the present invention is not limited to this, and it is allowable that the positioning portions B11 are formed to have a "V"-shaped shape, a "U"-shaped shape, etc. Further, the positioning part may be hole-shaped, instead of the recess-shaped.

In the first and second embodiments, an aspect is shown as an example of the light-emitting member, in which a plurality of LED is provided as the plurality of light-emitting sections. However, in order to form the plurality of the light-emitting sections, the number of the light-emitting element such as LED may be one. For example, it is allowable that one piece of a backlight such as a fluorescent lamp is prepared, and that optical shutters, constructed of liquid crystal or PLZT elements aligned in a row in the left and right direction, are arranged at the outside of the backlight. Namely, it is possible to form a plurality of light-emitting sections aligned in a row by using, in combination, one light-emitting element and one row of the optical shutters. Further, the light-emitting element is not limited to the LED, and may be an EL element (electroluminescence element), a fluorescent substance or body, etc.

In the first and second embodiments, the color printer of electro-photography system is described as an example of the image forming apparatus in which the exposure device of the present invention is applied. However, the present invention is not limited to these, and is applicable to an image-forming apparatus, other than the color printer of electro-photography system, such as a monochrome printer, a copy machine, a multi-function machine, etc.; and to a measuring apparatus, a tester (inspection apparatus), etc. other than the image-forming apparatus.

What is claimed is:

1. An image forming apparatus, comprising:

a photosensitive drum;

an exposure head having a first edge and a second edge separated from the first edge in a longitudinal direction, the exposure head having a first length in the longitudinal direction, and the exposure head including:

a light-emitting member which comprises a plurality of light-emitting sections arranged in the longitudinal direction; and a casing configured to hold the light-emitting member; and a supporting member having a second length, in the longitudinal direction, that is longer than the first length and having a third edge and a fourth edge separated from the third edge in the longitudinal direction, the supporting member being disposed at a side, of the exposure head, opposite to the photosensitive drum, wherein the supporting member supports the exposure head at a point between the first edge and the second edge in the longitudinal direction, wherein the supporting member holds the exposure head at a distance away from a surface of the supporting member that faces the exposure head, and wherein the supporting member comprises:

a first protrusion extending beyond the exposure head toward a surface of the photosensitive drum, the first protrusion being disposed between, in the longitudinal direction, the third edge of the supporting member and the first edge of the exposure head;

a second protrusion extending beyond the exposure head toward a surface of the photosensitive drum, the second protrusion being disposed between, in the longitudinal direction, the fourth edge of the supporting member and the second edge of the exposure head;

a first cam positioned between the surface of the supporting member and the exposure head, the first cam being positioned at a point between the first edge and the second edge in the longitudinal direction, and the first cam being configured to hold the exposure head at the distance away from the surface of the supporting member;

a second cam positioned between the surface of the supporting member and the exposure head, the second cam being positioned at a point between the first edge and the second edge in the longitudinal direction, and the second cam being configured to hold the exposure head at the distance away from the surface of the supporting member; and a first positioning pin arranged between the first cam and the second cam to position the supporting member with respect to the exposure head, the first positioning pin being inserted into a first hole of the exposure head.

2. The image forming apparatus according to claim 1, wherein the exposure head further comprises an elongated frame attached to the casing by an adhesive, and wherein the casing is made of resin and the elongated frame is made of metal.

3. The image forming apparatus according to claim 1, further comprising an adhesive configured to adhere an elongated frame to the casing, wherein the casing comprises a first wall and a second wall opposed to the first wall in a width direction that is orthogonal to an optical axis direction of the light-emitting member and the longitudinal direction, the first wall including one or more first projections extending in the optical axis direction, and the second wall including one or more second projections extending in the optical axis direction, wherein each of the first and second projections has a contact surface that faces the elongated frame in the optical axis direction, and wherein the adhesive adheres the elongated frame to the casing by adhering the elongated frame to the contact surfaces, which are coupled with the casing.

4. The image forming apparatus according to claim 1, wherein the casing comprises a first wall and a second wall opposed to the first wall in a width direction that is orthogonal to an optical axis direction of the light-emitting member and the longitudinal direction, the first wall including one or more first projections extending in the optical axis direction, and the second wall including one or more second projections extending in the optical axis direction, wherein each of the first and second projections has a contact surface that faces an elongated frame in the optical axis direction of the light-emitting member, and wherein the exposure head further comprises an elongated frame that is adhered to the contact surfaces by an adhesive.

5. The image forming apparatus according to claim 1, further comprising an adhesive configured to adhere an elongated frame to the casing, wherein the casing comprises a first wall and a second wall opposed to the first wall in a width direction that is orthogonal to an optical axis direction of the light-emitting member and the longitudinal direction, the first wall including one or more first projections extending in the optical axis direction, and the second wall including one or more second projections extending in the optical axis direction, wherein the adhesive is coated on the one or more first projections and the one or more second projections.

6. The image forming apparatus according to claim 5, further comprising a second adhesive filling a gap between the elongated frame and the casing.

7. The image forming apparatus according to claim 6, wherein the second adhesive has an elastic coefficient that is smaller than that of the adhesive.

8. The image forming apparatus according to claim 1, further comprising an adhesive configured to adhere an elongated frame to the casing, wherein the casing comprises a first wall and a second wall opposed to the first wall in a width direction that is orthogonal to an optical axis direction of the light-emitting member and the longitudinal direction, wherein the elongated frame has a first region that contacts the adhesive, wherein a first surface of the first wall has a second region that contacts the adhesive, wherein a second surface of the second wall has a third region that contacts the adhesive, wherein an area of the first region is greater than an area of the second region, and wherein the area of the first region is greater than an area of the third region.

9. The image forming apparatus according to claim 1, further comprising an adhesive configured to adhere an elongated frame to the casing, wherein a portion of an outer surface of the adhesive is tilted relative to an optical axis of the light-emitting member.

10. The image forming apparatus according to claim 1, further comprising an adhesive configured to adhere an elongated frame to the casing, wherein the casing comprises a first wall and a second wall opposed to the first wall in a width direction that is orthogonal to an optical axis direction of the light-emitting member and the longitudinal direction, wherein the first wall has a first surface that faces the elongated frame in the optical axis direction, wherein the second wall has a second surface that faces the elongated frame in the optical axis direction, wherein the first wall has a first flange having the first surface, and wherein the second wall has a second flange having the second surface.

11. The image forming apparatus according to claim 1, wherein the supporting member faces the photosensitive drum, wherein the first protrusion extends toward a first portion of a photosensitive surface of the photosensitive drum, and wherein the second protrusion extends toward a second portion of the photosensitive surface of the photosensitive drum.

12. The image forming apparatus according to claim 1, wherein the supporting member faces the photosensitive drum, and wherein the photosensitive drum is longer than a spacing between the first protrusion and the second protrusion.

13. The image forming apparatus according to claim 1, further comprising an adhesive configured to adhere an elongated frame to the casing, wherein the casing comprises a first wall and a second wall opposed to the first wall in a width direction that is orthogonal to an optical axis direction of the light-emitting member and the longitudinal direction, the first wall including one or more first projections extending in the optical axis direction, and the second wall including one or more second projections extending in the optical axis direction, wherein at least a portion of the adhesive is located on top of the first and second projections so that a layer of the adhesive exists between each of the first and second projections and the elongated frame.

14. The image forming apparatus according to claim 1, wherein the first cam comprises an eccentric cam disposed between the exposure head and a frame of the supporting member.

15. The image forming apparatus according to claim 1, wherein the first cam is configured to adjust the distance.

16. The image forming apparatus according to claim 1, wherein the first protrusion and the second protrusion are configured such that the first protrusion and the second protrusion do not penetrate a part of the supporting member.

17. The image forming apparatus according to claim 1, further comprising a second positioning pin arranged between the first cam and the first positioning pin to position the supporting member with respect to the exposure head, the second positioning pin being inserted into a second hole of the exposure head.

18. An image forming apparatus comprising:

a photosensitive drum;

an elongated frame extending along a longitudinal direction;

a light emitting diode head having a first edge and a second edge separated from the first edge in the longitudinal direction, the light emitting diode head having a first length in the longitudinal direction, and the light emitting diode head comprising:

a light emitting diode circuit board; and a casing configured to hold the light emitting diode circuit board, the casing attached to the elongated frame; and a supporting member having a second length, in the longitudinal direction, that is longer than the first length and having a third edge and a fourth edge separated from the third edge in the longitudinal direction, the supporting member being disposed at a side, of the light emitting diode head, opposite to the photosensitive drum, wherein the supporting member supports the light emitting diode head at a point between the first edge and the second edge in the longitudinal direction, wherein the supporting member holds the light emitting diode head at a distance away from a surface of the supporting member that faces the light emitting diode head, and wherein the supporting member comprises:

a first protrusion extending beyond the light emitting diode head toward a surface of the photosensitive drum, the first protrusion being disposed between, in the longitudinal direction, the third edge of the supporting member and the first edge of the light emitting diode head;

a second protrusion extending beyond the light emitting diode head toward a surface of the photosensitive drum, the second protrusion being disposed between, in the longitudinal direction, the fourth edge of the supporting member and the second edge of the light emitting diode head;

a first cam positioned between the surface of the supporting member and the light emitting diode head, the first cam being positioned at a point between the first edge and the second edge in the longitudinal direction, and the first cam being configured to hold the light emitting diode head at the distance away from the surface of the supporting member;

a second cam positioned between the surface of the supporting member and the light emitting diode head, the second cam being positioned at a point between the first edge and the second edge in the longitudinal direction, and the second cam being configured to hold the light emitting diode head at the distance away from the surface of the supporting member; and a first positioning pin arranged between the first cam and the second cam to position the supporting member with respect to the light emitting diode head, the first positioning pin being inserted into a first hole of the light emitting diode head.

19. The image forming apparatus according to claim 18, wherein the casing comprises a first wall and a second wall, where the first wall is opposite to the second wall relative to an imaginary plane that passes through the light emitting diode head and is perpendicular to a width direction that is perpendicular to both an optical axis direction of the light emitting diode head and the longitudinal direction.

20. The image forming apparatus according to claim 18, wherein the supporting member faces the photosensitive drum, wherein the first protrusion extends toward a first portion of a photosensitive surface of the photosensitive drum, and wherein the second protrusion extends toward a second portion of the photosensitive surface of the photosensitive drum.

21. The image forming apparatus according to claim 18, wherein the supporting member faces the photosensitive drum, and wherein the photosensitive drum is longer than a spacing between the first protrusion and the second protrusion.

22. The image forming apparatus according to claim 18, further comprising an adhesive configured to adhere the elongated frame to the casing, wherein the casing comprises a first wall and a second wall opposed to the first wall in a width direction that is orthogonal to an optical axis direction of the light emitting diode head and the longitudinal direction, the first wall including one or more first projections extending in the optical axis direction, and the second wall including one or more second projections extending in the optical axis direction, wherein at least a portion of the adhesive is located on top of the first and second projections so that a layer of the adhesive exists between each of the first and second projections and the elongated frame.

23. The image forming apparatus according to claim 18, wherein the first protrusion and the second protrusion do not contact the photosensitive drum.

24. The image forming apparatus according to claim 18, further comprising a second positioning pin arranged between the first cam and the first positioning pin to position the supporting member with respect to the light emitting diode head, the second positioning pin being inserted into a second hole of the light emitting diode head.

25. An image forming apparatus, comprising:

an exposure head having a first edge and a second edge separated from the first edge in a longitudinal direction, the exposure head having a first length in the longitudinal direction, and the exposure head including:

a light-emitting member which comprises a plurality of light-emitting sections arranged in the longitudinal direction; and a casing which holds the light-emitting member;

a frame configured to receive a photosensitive drum; and a supporting member having a second length, in the longitudinal direction, that is longer than the first length and having a third edge and a fourth edge separated from the third edge in the longitudinal direction, the supporting member being disposed at a side, of the exposure head, opposite to the photosensitive drum, wherein the supporting member supports the exposure head at a point between the first edge and the second edge in the longitudinal direction, and the supporting member holds the exposure head at a distance away from a surface of the supporting member that faces the exposure head, wherein the supporting member comprises:

a first protrusion extending beyond the exposure head toward a surface of the photosensitive drum;

a second protrusion extending beyond the exposure head toward a surface of the photosensitive drum;

a first cam positioned between the surface of the supporting member and the exposure head, the first cam being positioned at a point between the first edge and the second edge in the longitudinal direction, and the first cam being configured to hold the exposure head at the distance away from the surface of the supporting member;

a second cam positioned between the surface of the supporting member and the exposure head, the second cam being positioned at a point between the first edge and the second edge in the longitudinal direction, and the second cam being configured to hold the exposure head at the distance away from the surface of the supporting member; and a first positioning pin arranged between the first cam and the second cam to position the supporting member with respect to the exposure head, the first positioning pin being inserted into a first hole of the exposure head, wherein the first protrusion is disposed between, in the longitudinal direction, the third edge of the supporting member and the first edge of the exposure head, and wherein the second protrusion is disposed between, in the longitudinal direction, the fourth edge of the supporting member and the second edge of the exposure head.

26. The image forming apparatus according to claim 25, wherein the supporting member faces the photosensitive drum, wherein the first protrusion extends toward a first portion of a photosensitive surface of the photosensitive drum, and wherein the second protrusion extends toward a second portion of the photosensitive surface of the photosensitive drum.

27. The image forming apparatus according to claim 25, wherein the photosensitive drum is longer than a spacing between the first protrusion and the second protrusion.

28. The image forming apparatus according to claim 25, further comprising an adhesive configured to adhere an elongated frame to the casing, wherein the casing comprises a first wall and a second wall opposed to the first wall in a width direction that is orthogonal to an optical axis direction of the light-emitting member and the longitudinal direction, the first wall including one or more first projections extending in the optical axis direction, and the second wall including one or more second projections extending n the optical axis direction, wherein at least a portion of the adhesive is located on top of the first and second projections so that a layer of the adhesive exists between each of the first and second projections and the elongated frame.

29. The image forming apparatus according to claim 25, wherein the first protrusion and the second protrusion are integrally formed with a body portion of the supporting member and fixed in position with respect to the body portion of the supporting member.

30. The image forming apparatus according to claim 25, further comprising a second positioning pin arranged between the first cam and the first positioning pin to position the supporting member with respect to the exposure head, the second positioning pin being inserted into a second hole of the exposure head.

* * * * *